US009162480B2

(12) United States Patent
Ishimi et al.

(10) Patent No.: US 9,162,480 B2
(45) Date of Patent: Oct. 20, 2015

(54) IMAGE ERASING APPARATUS AND IMAGE ERASING METHOD

(71) Applicants: Tomomi Ishimi, Shizuoka (JP); Shinya Kawahara, Shizuoka (JP); Toshiaki Asai, Shizuoka (JP); Yoshihiko Hotta, Shizuoka (JP)

(72) Inventors: Tomomi Ishimi, Shizuoka (JP); Shinya Kawahara, Shizuoka (JP); Toshiaki Asai, Shizuoka (JP); Yoshihiko Hotta, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/354,739

(22) PCT Filed: Nov. 28, 2012

(86) PCT No.: PCT/JP2012/081428

§ 371 (c)(1),
(2) Date: Apr. 28, 2014

(87) PCT Pub. No.: WO2013/084903

PCT Pub. Date: Jun. 13, 2013

(65) Prior Publication Data

US 2014/0285606 A1 Sep. 25, 2014

(30) Foreign Application Priority Data

Dec. 5, 2011 (JP) ..... 2011-265370

(51) Int. Cl.

| | |
|---|---|
| ***B41M 7/00*** | (2006.01) |
| ***B41J 2/47*** | (2006.01) |
| ***B41J 2/315*** | (2006.01) |

(Continued)

(52) U.S. Cl.

CPC .. *B41J 2/315* (2013.01); *B41J 2/32* (2013.01); *B41J 2/4753* (2013.01); *B41M 7/0009* (2013.01); *B41J 2/47* (2013.01); *B41J 2202/37* (2013.01)

(58) Field of Classification Search

USPC ..... 347/179

See application file for complete search history.

(56) References Cited

U.S. PATENT DOCUMENTS

| | | | |
|---|---|---|---|
| 6,738,129 | B2 | 5/2004 | Mizouchi |
| 7,439,993 | B2 | 10/2008 | Ishimi et al. |

(Continued)

FOREIGN PATENT DOCUMENTS

| | | | |
|---|---|---|---|
| EP | 2 165 840 | A1 | 3/2010 |
| EP | 2 311 643 | A1 | 4/2011 |

(Continued)

OTHER PUBLICATIONS

International Search Report Issued Jan. 15, 2013 in PCT/JP2012/081428 Filed on Nov. 28, 2012.

(Continued)

*Primary Examiner* — Huan Tran

(74) *Attorney, Agent, or Firm* — Oblon, McClelland, Maier & Neustadt, L.L.P.

(57) ABSTRACT

A method for uniformly erasing an image recorded on a thermo-reversible recording medium. The image erasing apparatus includes an LD array, which emits a laser light whose cross section has a line shape; optics which include at least one cylindrical lens which converts, into a converging light which converges in a width direction, a line-shaped laser light which is emitted from the LD array and emits the converging light; and a mono-axial galvano mirror which deflects the laser light emitted from the optics in the width direction to scan the deflected laser light onto the thermo-reversible recording medium.

9 Claims, 11 Drawing Sheets

(51) Int. Cl.
*B41J 2/32* (2006.01)
*B41J 2/475* (2006.01)

(56) References Cited

U.S. PATENT DOCUMENTS

| | | | | |
|---|---|---|---|---|
| 7,728,860 | B2 | 6/2010 | Kawahara et al. | |
| 7,972,990 | B2 | 7/2011 | Iino et al. | |
| 8,098,266 | B2 | 1/2012 | Asai et al. | |
| 8,101,334 | B2 | 1/2012 | Ishimi et al. | |
| 8,106,934 | B2 | 1/2012 | Ishimi et al. | |
| 8,284,222 | B2 * | 10/2012 | Ishimi et al. | 347/179 |
| 8,293,679 | B2 | 10/2012 | Asai et al. | |
| 8,358,325 | B2 | 1/2013 | Asai et al. | |
| 8,455,161 | B2 | 6/2013 | Asai et al. | |
| 8,628,898 | B2 | 1/2014 | Kawahara et al. | |
| 8,643,689 | B2 | 2/2014 | Ishimi et al. | |
| 2007/0225162 | A1 | 9/2007 | Kawahara et al. | |
| 2008/0192618 | A1 | 8/2008 | Nakata et al. | |
| 2009/0075816 | A1 | 3/2009 | Kawahara et al. | |
| 2011/0090296 | A1 | 4/2011 | Ishimi et al. | |
| 2012/0211673 | A1 * | 8/2012 | Yamamoto | 250/492.1 |

FOREIGN PATENT DOCUMENTS

| | | | | |
|---|---|---|---|---|
| JP | 07-179061 | | 7/1995 | |
| JP | 09-030118 | | 2/1997 | |
| JP | 10-092729 | | 4/1998 | |
| JP | 11-151856 | | 6/1999 | |
| JP | 2000-136022 | | 5/2000 | |
| JP | 2001-88333 | * | 4/2001 | B41J 2/32 |
| JP | 3256090 | | 2/2002 | |
| JP | 2004-265247 | | 9/2004 | |
| JP | 2004-265249 | | 9/2004 | |
| JP | 3605047 | | 12/2004 | |
| JP | 2007-214580 | | 8/2007 | |
| JP | 2008-062506 | | 3/2008 | |
| JP | 2008-068630 | | 3/2008 | |
| JP | 2008-137243 | | 6/2008 | |
| JP | 2008-213439 | | 9/2008 | |
| JP | 2009-096011 | | 5/2009 | |
| JP | 2011-104995 | | 6/2011 | |
| WO | WO 2012/033146 A1 | | 3/2012 | |

OTHER PUBLICATIONS

Extended European Search Report issued Aug. 13, 2014 in Patent Application No. 12854898.9.

* cited by examiner

IMAGE ERASING APPARATUS AND IMAGE ERASING METHOD

TECHNICAL FIELD

The present invention relates to image erasing apparatuses and image erasing methods which scan a laser light onto a thermo-reversible recording medium to erase an image recorded on the thermo-reversible recording medium.

BACKGROUND ART

In a related art is known an image erasing apparatus which deflects, in a width direction, a laser light whose cross section is line shaped to scan the deflected laser light onto the thermo-reversible recording medium to erase an image recorded on the thermo-reversible recording medium (see Patent Document 1, for example).

However, in Patent Document 1, as an incident angle of the laser light onto the thermo-reversible recording medium of the line shaped laser light changes, an energy density of the laser light irradiated onto the thermo-reversible recording medium changes, so that it is difficult to uniformly erase the image recorded onto the thermo-reversible recording medium.

SUMMARY OF THE INVENTION

Means for Solving the Problems

According to the present invention, an image erasing apparatus which scans a laser light on a thermo-reversible medium on which an image is recorded is provided, the image erasing apparatus including a light source which emits a laser light whose cross section has a line shape; optics which converts the laser light emitted from the light source into a converging light which converges in a width direction to emit the converging light; and a scanning unit which deflects, in the width direction, the laser light emitted from the optics to scan the deflected laser light on the thermo-reversible recording medium.

The present invention makes it possible to uniformly erase an image recorded on the thermo-reversible recording medium.

BRIEF DESCRIPTION OF THE DRAWINGS

FIG. 2A is a graph illustrating color formation-color erasure characteristics of the thermo-reversible recording medium, while

FIG. 6A is a graph showing an erasing characteristic of a central portion and a peripheral portion of the thermo-reversible recording medium in Embodiment 1 of the present invention, while

Figure 1A:
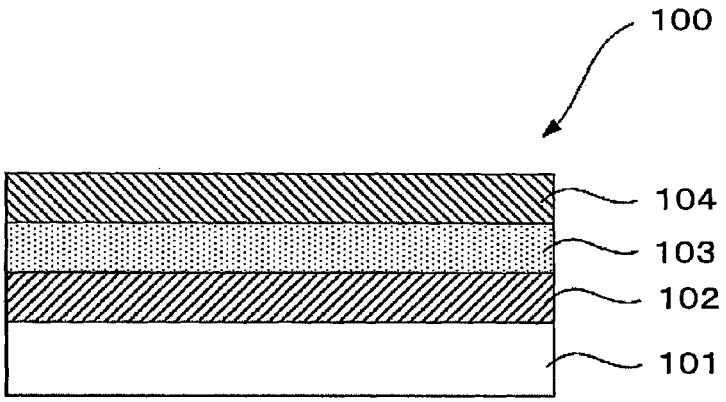
FIGS. 1A to 1C are schematic cross sectional diagrams illustrating an example (first to third parts) of a layer configuration of a thermo-reversible recording medium of the present invention.

MODE FOR CARRYING OUT THE INVENTION (Image Erasing Apparatus and Image Erasing Method)

An image erasing apparatus of the present invention at least includes a light source which emits a laser light whose cross section has a line shape; optics; and a scanning unit and, as required, includes an irradiating energy amount control unit and other units.

An image erasing method of the present invention at least includes a converting step and a scanning step and, as required, includes other steps.

According to the image erasing apparatus and the image erasing method of the present invention, the laser light whose cross section has the line shape that is emitted from the light source is converted to a converging light which converges in the width direction, the laser light converted to the converging light is deflected in a width direction to scan the deflected laser light on the thermo-reversible recording medium to erase an image recorded on the thermo-reversible recording medium.

The image erasing method of the present invention makes it possible to embody suitably with the image erasing apparatus of the present invention, the converting step that may be performed by the optics, the scanning step that may be performed by the scanning unit, and the other steps that may be performed by the other units.

Light Source

As an example, the light source, which is a one-dimensional laser array including multiple semiconductor lasers arranged in a mono-axis direction (one-dimensionally aligned), emits a laser light whose cross section has a line shape.

The one-dimensional laser array preferably includes three to 300 semiconductor lasers, and more preferably includes 10 to 100 thereof.

When the number of semiconductor lasers is small, it may not be possible to increase irradiating power, while, when it is too large, a large-scale cooling apparatus for cooling the one-dimensional laser array may become necessary.

A length in a longitudinal direction of a light emitting unit of the one-dimensional laser array, for which there is no particular restriction and which may be appropriately selected according to a purpose thereof, is preferably between 1 mm to 50 mm and more preferably between 3 mm and 15 mm. When the length in the longitudinal direction of the light emitting unit of the one-dimensional laser array is less than 1 mm, it may become not possible to increase the irradiating power, while, when it exceeds 50 mm, a large-scale cooling apparatus for cooling the one-dimensional laser array may become necessary, so that a cost of the apparatus may increase.

Here, the light emitting unit of the one dimensional laser array means a portion which is effectively and actually emitting light in the one-dimensional laser array.

The light source may be a two-dimensional laser array which includes multiple semiconductor laser arrays which are two-dimensionally aligned, for example, as long as a cross section thereof emits a line-shaped laser light.

Moreover, the light source may include a solid state laser, a fiber laser, a $CO_2$ laser, etc., in lieu of the semiconductor laser.

A wavelength of the laser light in the one-dimensional laser array is preferably at least 700 nm, more preferably at least 720 nm, and further preferably at least 750 nm. An upper limit of the wavelength of the laser light, which may be appropriately selected according to a purpose thereof, may be preferably less than or equal to 1,500 nm, more preferably less than or equal to 1,300 nm, and further preferably less than or equal to 1,200 nm.

When the wavelength of the laser light is set to a wavelength which is shorter than 700 nm, problems arise that a contrast decreases at the time of image recording of the thermo-reversible recording medium in a visible light region and that the thermo-reversible recording medium gets colored. Moreover, there is a problem that it becomes more likely for deterioration of the thermo-reversible recording medium to occur in an ultra-violet region in which the wavelength is even shorter. Moreover, for a photothermal conversion material to be added to the thermo-reversible recording medium, a high decomposition temperature is necessary for maintaining durability against repeated image processing, so that it is difficult to obtain a photothermal conversion material with the high decomposition temperature and a long absorption wavelength when organic dyes are used for the photothermal conversion material. Therefore, the wavelength of the laser light is preferably less than or equal to 1,500 nm.

Converting Process and Optics

The converting process, which is a process of converting a line-shaped laser light emitted from the one dimensional laser array (below-called a line-shaped beam) into a converging light which converges in a width direction (a short direction), may be realized with the optics. The "width direction" is a direction which is parallel to a direction orthogonal to an alignment direction of multiple semiconductor lasers.

The optics, which is arranged on an optical path of a line-shaped beam emitted from the one-dimensional laser array, converts the line-shaped beam into a converging light which converges in the width direction to emit the converged light to the scanning unit.

The optics at least includes a width-direction converging unit and also, as required, includes at least one of a width-direction parallelizing unit, a longitudinal-direction light distribution uniformalizing unit, and a longitudinal-direction parallelizing unit.

The width-direction converging unit is arranged on an optical path of the line-shaped beam between the one-dimensional laser array and the scanning unit.

The width-direction converging unit, for which there is no particular restriction, may be appropriately selected depending on a purpose thereof, so that it can be realized with a cylindrical lens (a light collecting element), or a combination of multiple cylindrical lenses.

In other words, at least one cylindrical lens is arranged such that a line-shaped beam which is emitted to the scanning unit converges in the width direction. In this case, a position of the at least one cylindrical lens is determined in accordance with a focal length thereof.

The width-direction parallelizing unit, which is arranged on an optical path of the line-shaped beam between the one dimensional laser array and the width direction converging unit, parallelizes, in the width direction, the line-shaped beam emitted from the one-dimensional laser array.

The width-direction parallelizing unit, for which there is no particular restriction, may be appropriately selected in accordance with a purpose thereof, so that it includes, for example, a combination of concave cylindrical lenses, multiple convex cylindrical lenses, a cylindrical lens with one convex side, etc.

The line-shaped beam from the one-dimensional laser array has a large divergence angle in the width direction relative to that in a length direction (the longitudinal direction), so that the width-direction parallelizing unit is preferably arranged in proximity to an emitting face of the one-dimensional laser array. In this case, divergence of the line-shaped beam in the width direction may be suppressed as much as possible and the lens may be made small as much as possible. "The length direction" is a direction which is parallel to an alignment direction of multiple semiconductor lasers.

The length direction light distribution uniformalizing unit, which is arranged on an optical path of the line-shaped beam between the one dimensional laser array and the scanning unit, causes the line-shaped beam to uniformly diverge in the length direction to uniformize the light distribution of the line-shaped beam in the length direction.

The length direction light distribution uniformizing unit is preferably arranged on an optical path of the line-shaped beam between the width direction parallelizing unit and the width direction converging unit.

The length direction light distribution uniformizing unit, for which there is no particular restriction, may be appropriately selected in accordance with a purpose thereof, so that it can be realized with a combination of non-spherical cylindrical lenses, and spherical lens, for example. For example, the non-spherical cylindrical lens (length direction) includes a micro lens array, a convex lens array, a concave lens array, a Fresnel lens, etc. The lens array represents a set of multiple convex or concave lenses which are aligned in the length direction. The line-shaped beam can be caused to diverge in the length direction with the non-spherical cylindrical lens to obtain a uniform light distribution.

The length direction parallelizing unit, which is arranged on an optical path of the line-shaped beam between the one-dimensional laser array and the scanning unit, parallelizes the line-shaped beam in the length direction.

The length direction parallelizing unit is preferably arranged on an optical path of the line-shaped beam between the length direction distribution uniformizing unit and the scanning unit.

The length direction parallelizing unit, for which there is no particular restriction, may be appropriately selected in accordance with a purpose thereof, so that it can be realized with a spherical lens, for example.

In other words, the spherical lens is arranged to parallelize, in the length direction, a line-shaped beam emitted to the scanning unit. In this case, a position of the spherical lens is determined in accordance with the focal distance thereof.

A length of the line-shaped beam which is parallelized by the length direction parallelizing unit is preferably between 10 mm and 300 mm and more preferably between 30 mm and 160 mm. An erasable region is determined in accordance with the length of the line-shaped beam, so that the erasable region becomes narrow when the length thereof is short.

The length of the line-shaped beam is preferably more than twice and is more preferably more than three times the length in the longitudinal direction of the light emitting unit of the one dimensional laser array. When the length of the line-shaped beam is shorter than the length of the longitudinal direction of the light emitting unit of the one-dimensional laser array, it is necessary to make a light source of the one-dimensional laser array long in order to maintain a long erasing region, possibly leading to an increased cost of the apparatus and an increased apparatus size.

The scanning unit, which is arranged on the optical path of the line-shaped beam via the optics, deflects, in the width direction, the line-shaped beam converted with the optics to the converging light which converges in the width direction to scan the deflected line-shaped beam on the thermo-reversible recording medium. As a result, an image recorded on the thermo-reversible recording medium is erased.

The scanning unit, for which there is no particular restriction as long as it may deflect the line-shaped beam in the width direction (a monoaxial direction), may be appropriately selected in accordance with a purpose thereof, so that it includes a monoaxial galvano-mirror, a polygon mirror, a stepping motor mirror, etc., for example.

It is possible to finely control speed adjustments with the monoaxial galvano-mirror and stepping motor mirror; the stepping motor mirror is inexpensive compared to the monoaxial galvano-mirror; and the polygon mirror, with which speed adjustments are difficult, is inexpensive.

A beam width of the line-shaped beam on the thermo-reversible recording medium is preferably between 0.1 mm and 10 mm and is more preferably between 0.2 mm and 5 mm. With the beam width, a time to heat the thermo-reversible medium (a heating time) may be controlled. When the beam width is too narrow, the heating time becomes short, causing erasability to decrease. On the other hand, when the beam width is too wide, as the heating time becomes long, excessive energy is provided to the thermo-reversible recording medium, so that a large amount of energy becomes necessary, making erasing at high speed difficult. Therefore, it is desired to adjust to a beam width which is suitable for erasing characteristics of the thermo-reversible recording medium.

Moreover, a scanning speed (a deflecting speed) of the line-shaped beam, for which there is no particular restriction, is preferably at least 2 mm/s, more preferably at least 10 mm/s, and further preferably at least 20 mm/s. When the scanning speed is less than 2 mm/s, it takes time for image erasing. Moreover, an upper limit of the scanning speed of the laser light, for which there is no particular restriction, may be appropriately selected in accordance with a purpose thereof, is preferably less than or equal to 1000 mm/s, more preferably less than or equal to 300 mm/s, and further preferably less than or equal to 100 mm/s. When the scanning speed exceeds 1000 mm/s, a uniform image erasing may become difficult.

Moreover, an output of the line-shaped beam, for which there is no particular restriction, may be appropriately selected in accordance with a purpose thereof, is preferably at least 10 W, more preferably at least 20 W, and further preferably at least 40 W. When the output of the line-shaped beam is less than 10 W, it takes time for the image erasing, while, when it is sought to shorten the image erasing time, a shortage of output occurs, causing an image erasing failure. Moreover, an upper limit of the output of the line-shaped beam, for which there is no particular restriction, may be appropriately selected in accordance with a purpose thereof, is preferably less than or equal to 500 W, more preferably less than or equal to 200 W, and further preferably less than or equal to 120 W. When the output of the laser light exceeds 500 W, a cooling apparatus of the semiconductor laser could become large.

For scanning the line-shaped beam on the thermo-reversible recording medium, the line-shaped beam may be scanned on a stopped thermo-reversible recording medium to erase an image recorded on the thermo-reversible recording medium, or the thermo-reversible recording medium may be moved by a moving unit and the line-shaped beam may be scanned on the thermo-reversible recording medium to erase an image recorded on the thermo-reversible recording medium. The moving unit includes a conveyor, a stage, etc., for example. In this case, it is preferable to move a container by a conveyor to move the thermo-reversible recording medium, on a surface of which container the thermo-reversible recording medium is pasted.

The container includes a cardboard box, a plastic container, a box, etc., for example.

Now, as described above, when the line-shaped beam is scanned in a width direction on the thermo-reversible recoding medium to erase an image recorded on the thermo-reversible recording medium, a heating time of the thermo-reversible recording medium, or, in other words, a beam width of the line-shaped beam on the thermo-reversible recording medium impacts erasing characteristics.

Figure 9A:
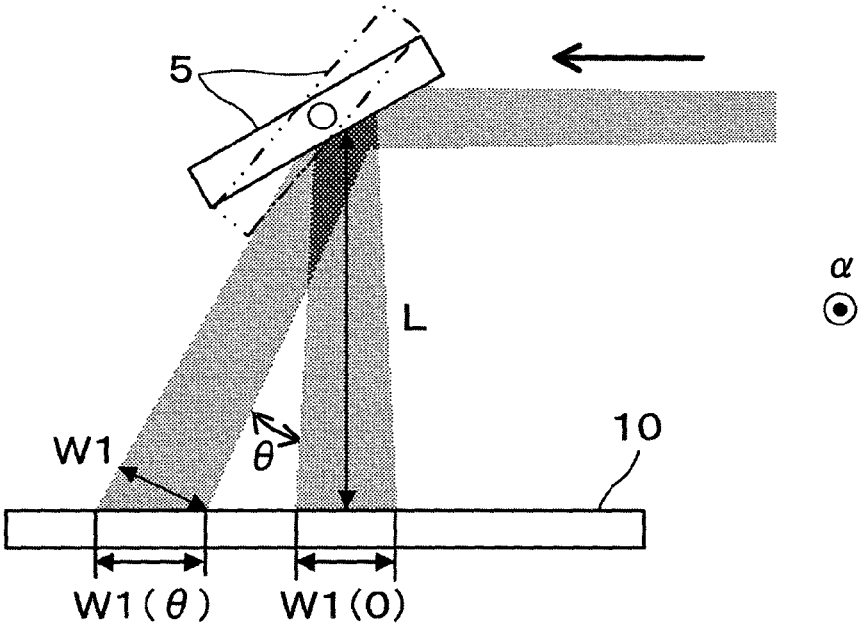
FIGS. 9A and 9B are diagrams for describing a width of a beam in irradiating onto the thermo-reversible recording medium while deflecting a line-shaped beam in Comparative Example (part 1 and 2)
Figure 9B:
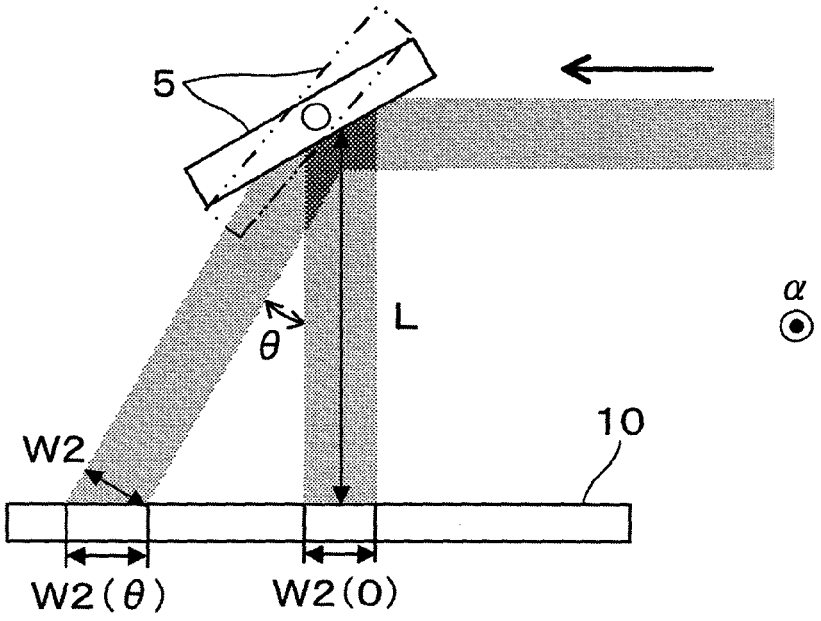
Figure 10:
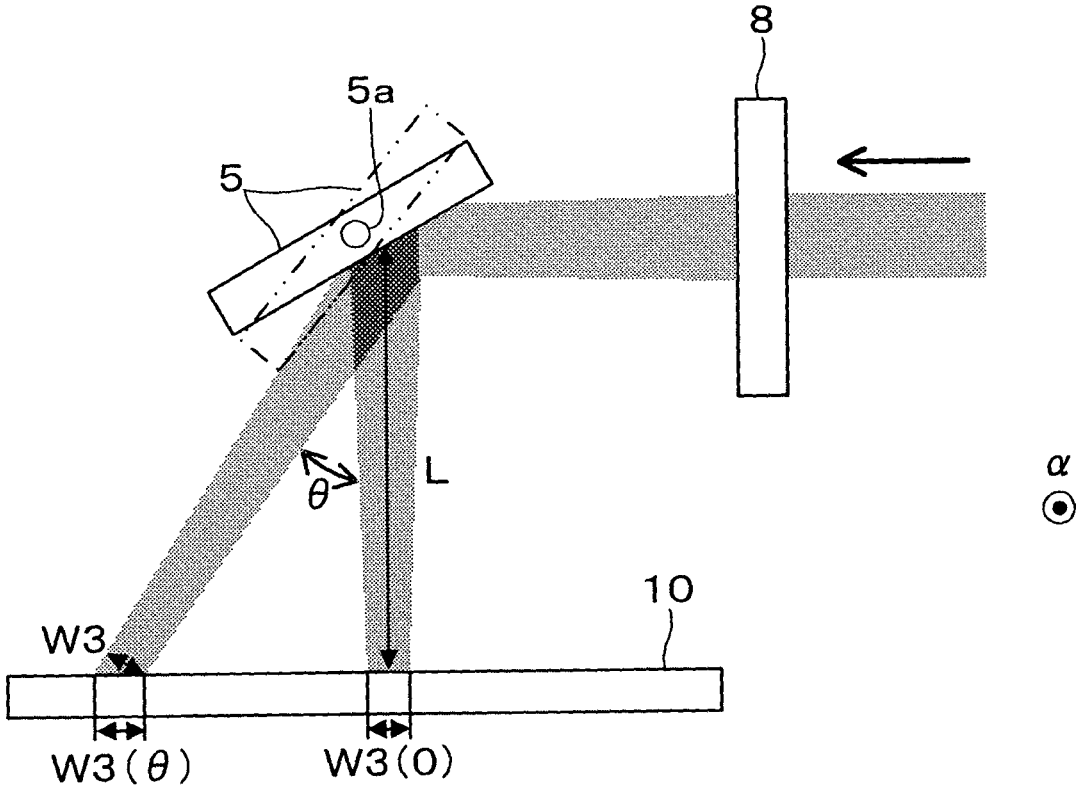
FIG. 10 is a diagram for describing a width of a beam in irradiating onto the thermo-reversible recording medium while deflecting the line-shaped beam in one embodiment of the present invention.

Here, as seen from FIGS. 9A to 10, for example, when the line-shaped beam is scanned on the thermo-reversible recording medium by the scanning unit, a proceeding direction of the line-shaped beam changes and an angle of incidence of the line-shaped beam onto the thermo-reversible recoding medium changes. Then, when an angle of incidence of the line-shaped beam onto the thermo-reversible recording medium changes, a beam width on the thermo-reversible recording medium normally changes.

In this case, in order to perform a uniform erasure on the whole face of the thermo-reversible recording medium, it is desirable that a change in the beam width (a change in the heating time) on the thermo-reversible recording medium due to a change in an angle of incidence of the line-shaped beam be as small as possible and that a beam width on the thermo-reversible recording medium becomes constant as much as possible regardless of the scanning position of the line-shaped beam.

As shown in FIG. 9A, in case the line-shaped beam which is deflected by the scanning unit diverges in the width direction, or, in other words, the line-shaped beam proceeds while it diverges in the width direction, the line-shaped beam diverges more and is incident onto the thermo-reversible recording medium at a larger angle of incidence the longer a length of an optical path between the scanning unit and the thermo-reversible recording medium (the larger the θ in FIG. 9A). The θ in FIG. 9A is an angle of deflection of the line-shaped beam with a direction vertical to the thermo-reversible recording medium as a reference.

Here, assuming a beam width immediately before being incident onto the thermo-reversible recording medium of W1 and a beam width on the thermo-reversible recording medium of W1(θ), W1(θ)=W1/cos θ.

In this case, W1 becomes larger the larger the θ, and cos θ is a decreasing function of θ.

In other words, the beam width on the thermo-reversible recording medium becomes markedly large the longer the above-mentioned optical path length (the larger the θ). In other words, a change in the beam width on the thermo-reversible recording medium due to a change in an angle of incidence of the line-shaped beam is markedly large.

Moreover, as shown in FIG. 9B, in case the line-shaped beam which is deflected by the scanning unit is parallelized in the width direction, or, in other words, the line-shaped beam proceeds in a constant width, the line-shaped beam is incident onto the thermo-reversible recording medium at a larger angle of incidence the longer a length of an optical path between the scanning unit and the thermo-reversible recording medium (the larger the θ in FIG. 9B). The θ in FIG. 9B is an angle of deflection of the line-shaped beam with a direction vertical to the thermo-reversible recording medium as a reference.

Here, with a beam width immediately before being incident onto the thermo-reversible recording medium of W2 and a beam width on the thermo-reversible recording medium of W2 (θ), W2 (θ)=W2/cos θ.

In this case, W2 is constant and cos θ is a decreasing function of θ.

In other words, the beam width on the thermo-reversible recording medium becomes large the longer the above-mentioned optical path length (the larger the θ). In other words, a change in the beam width on the thermo-reversible recording medium due to a change in an angle of incidence of the line-shaped beam is large.

Moreover, as shown in FIG. 10, in case the line-shaped beam which is deflected by the scanning unit converges in the width direction, or, in other words, the line-shaped beam proceeds while narrowing in the width direction, the line-shaped beam is incident onto the thermo-reversible recording medium such that it is narrower and at a larger angle of incidence the longer a length of an optical path between the scanning unit and the thermo-reversible recording medium (the larger the θ in FIG. 10). The θ in FIG. 10 is an angle of deflection of the line-shaped beam with a direction vertical to the thermo-reversible recording medium as a reference.

Here, assuming a beam width immediately before being incident onto the thermo-reversible recording medium of W3 and a beam width on the thermo-reversible recording medium of W3 (θ), W3 (θ)=W3/cos θ.

In this case, W3 becomes smaller the larger the θ, and cos θ is a decreasing function of θ.

In other words, a change of the beam width on the thermo-reversible medium due to a change in the optical path length is small. In other words, a change in the beam width on the thermo-reversible recording medium due to a change in an angle of incidence of the line-shaped beam is small.

Thus, as described above, the optics of the image erasing apparatus of the present invention has a width-direction converging unit and converts a line-shaped beam which is caused to be incident by the scanning unit to a converging light which converges in the width direction, making it possible to reduce a change in the beam width (heating time) on the thermo-reversible recording medium due to a change in an angle of incidence of the line-shaped beam and, as a result, making it possible to perform a uniform erasure on the whole face of the thermo-reversible recording medium.

Then, at least one of arrangement and a focal position of the width direction converging unit; a distance between the scanning unit and the thermo-reversible recording medium, etc., may be changed to adjust a level of convergence in the width direction of the line-shaped beam which is caused to be incident onto the thermo-reversible recording medium, so that a change in the beam width on the thermo-reversible recording medium due to a change in an angle of incidence of the line-shaped beam can be set to be almost zero, or in other words a beam width W3 (θ) on the thermo-reversible recording medium can be set to be almost constant regardless of a scanning position of the line-shaped beam or in other words regardless of θ. As a result, a more uniform erasure may be performed on the whole face of the thermo-reversible recording medium.

Now, even when the beam width on the thermo-reversible recording medium could be set to be almost constant regardless of the angle of incidence of the line-shaped beam, in case the line-shaped beam which is incident on the scanning unit diverges or converges in the length direction, an optical path length of the line-shaped beam changes due to a change in an angle of incidence of the line-shaped beam by the scanning unit, so that the length (the beam length) of the line-shaped beam on the thermo-reversible recording medium changes.

In this case, an irradiation area (a beam width×a beam length) of the line-shaped beam on the thermo-reversible recording medium, or in other words an irradiating energy density changes due to a change in an angle of incidence of the line-shaped beam.

Therefore, in order to perform a more uniform erasure on the whole face of the thermo-reversible recording medium, it is desirable to parallelize, in the length direction, the line-shaped beam which is caused to be incident by the scanning unit.

Then, as described above, the optics of the image erasing apparatus of the present invention, which includes a length direction parallelizing unit as needed, may parallelize, in the length direction, the line-shaped beam which is caused to be incident by the scanning unit to suppress a change in the beam length on the thermo-reversible recording medium due to a change in an angle of incidence of the line-shaped beam. As a result, an irradiation area (an irradiating energy density) of the line-shaped beam on the thermo-reversible recording medium may be set to be constant as much as possible regardless of the scanning position of the line-shaped beam.

Moreover, as described above, the image erasing apparatus of the present invention, which includes a length direction light distribution uniformizing unit as needed, may uniformize a light distribution in the length direction of the line-shaped beam which is caused to be incident by the scanning unit. As a result, it is possible to uniformize the irradiating energy density of the line-shaped beam in the length direction.

As described above, the optics may include one of the length direction parallelizing unit and the length direction light distribution uniformizing unit in addition to the width direction converging unit to perform a more uniform erasure with respect to the whole face of the thermo-reversible recording medium. Moreover, the optics may include both the length direction parallelizing unit and the length direction light distribution uniformizing unit in addition to the width direction converging unit to perform an extremely uniform erasure on the whole face of the thermo-reversible recording medium.

The irradiating energy amount control unit is a unit which adjusts an amount of energy irradiated onto the thermo-reversible recording medium.

The irradiating energy amount control unit includes those having a temperature sensor which measures a temperature of the thermo-reversible recording medium or the surroundings thereof; and an output adjusting apparatus which adjusts an output of the one-dimensional laser array based on a measured value of the temperature sensor. The irradiating energy amount control unit may include a heating time adjusting apparatus which adjusts a heating time of the thermo-reversible recording medium based on the measured value of the temperature sensor, for example, in lieu of the output, adjusting apparatus.

In this case, regardless of a temperature of the thermo-reversible recording medium, irradiating energy having a magnitude which is more suitable for erasing an image may be irradiated onto the thermo-reversible recording medium.

Moreover, the irradiating energy amount control unit may include a distance sensor (a displacement sensor) which measures a distance between the thermo-reversible recording medium and the scanning unit in lieu of the temperature sensor. In this case, it may be arranged for the output adjusting apparatus to adjust an output of the one-dimensional laser array based on the measured value of the distance sensor, or it may be arranged for the heating time adjusting apparatus to adjust the heating time of the thermo-reversible recording medium based on the measured value of the distance sensor.

In this case, the beam width on the thermo-reversible recording medium changes in accordance with a distance between the thermo-reversible recording medium and the scanning unit, making it possible to control an irradiating energy amount taking into account a change in the beam width and, as a result, to irradiate, onto the thermo-reversible recording medium, irradiating energy of a magnitude which is more suitable for erasing an image regardless of the distance between the thermo-reversible recording medium and the scanning unit.

The irradiating energy amount control unit may include the temperature sensor and the distance sensor. In this case, it may be arranged for the output adjusting apparatus to adjust an output of the one-dimensional laser array based on the measured value of the temperature sensor and the distance sensor, or it may be arranged for the heating time adjusting apparatus to adjust the heating time of the thermo-reversible recording medium based on the measured value of the temperature sensor and the distance sensor.

Moreover, the irradiating energy amount control unit may include an output adjusting apparatus which adjusts an output of the one dimensional laser array in accordance with a scanning position of the line-shaped beam when the line-shaped beam is scanned by the scanning unit. In this case, it may be arranged for the irradiating energy amount control unit to detect a scanning position of the line-shaped beam from an operating state of the scanning unit.

This makes it possible to uniformize the irradiating energy density on the thermo-reversible recording medium regardless of the scanning position of the line-shaped beam even in case the beam irradiation area on the thermo-reversible recording medium changes due to a change in the angle of incidence of the line-shaped beam. As a result, a more uniform erasure may be performed on whole face of the thermo-reversible recording medium.

The irradiating energy amount control unit may include a heating time adjusting apparatus which adjusts a heating time of the thermo-reversible recording medium based on the angle of incidence of the line-shaped beam in lieu of the output adjusting apparatus.

Other Processes and Other Units

Other processes, for which there is no particular restriction, may be appropriately selected in accordance with a purpose thereof, so that they include a control process, for example.

The control process, which is a process which controls the respective processes, may be preferably performed by a control unit.

The control unit, for which there is no particular restriction as long as it may control a movement of the respective units, may be appropriately selected in accordance with a purpose thereof, so that it includes equipment units such as a sequencer, a computer, etc.

Thermo-Reversible Recording Medium

In the thermo-reversible recording medium, one of transparency and color tone reversibly changes in dependence on temperature.

The thermo-reversible recording medium, for which there is no particular restriction, and that may be appropriately selected in accordance with a purpose thereof, includes, for example, a support; and a first thermo-reversible recording layer, a photothermal conversion layer, and a second thermo-reversible recording layer in this order on the support; and also includes, as needed, other layers such as an appropriate selection of a first oxygen barrier layer, a second oxygen barrier layer, an ultra-violet absorbing layer, a back layer, a protective layer, an intermediate layer, an under layer, an adhesive layer, a tackiness layer, a coloring layer, an air layer, a light reflective layer, etc. The photothermal conversion material can be added to the thermo-reversible recording layer to make the first and second thermo-reversible recording layers into one, eliminating the photothermal conversion layer. The respective layers may be of a single layer structure or a laminated structure. A layer to be provided above the photothermal conversion layer is preferably configured using a material with less absorption at a specific wavelength in order to reduce an energy loss of the laser light to be irradiated that has a specific wavelength.

Here, as illustrated in FIG. 1A, a mode of a layer configuration of a thermo-reversible recording medium 100 includes a support 101; and a first thermo-reversible recording layer 102, a photothermal conversion layer 103, and a second thermo-reversible recording layer 104 in this order on the support.

Figure 1B:
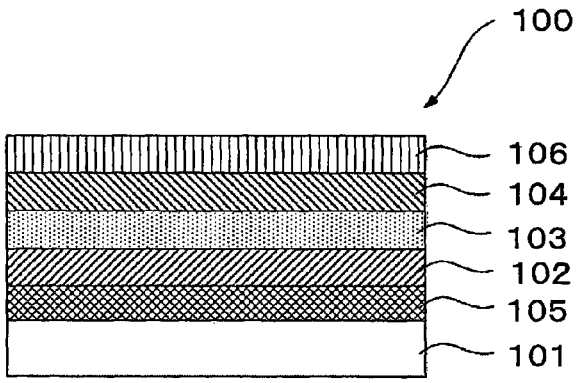
Figure 1C:
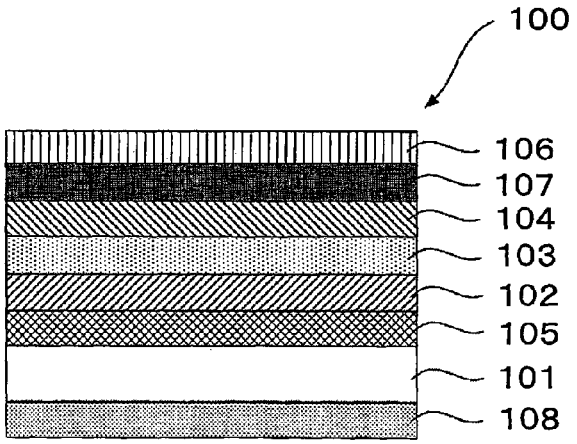

Moreover, as shown in FIG. 1B, a mode thereof includes a support 101; and a first oxygen barrier layer 105, a first thermo-reversible recording layer 102, a photothermal conversion layer 103, a second thermo-reversible recording layer 104, and a second oxygen barrier layer 106 in this order on the support, Moreover, as shown in FIG. 1C, a mode thereof includes a support 101; and a first oxygen barrier layer 105, a first thermo-reversible recording layer 102, a photothermal conversion layer 103, a second thermo-reversible recording layer 104, an ultra-violet absorbing layer 107, and a second oxygen barrier layer 106 in this order on the support, and includes a back layer 108 on a face on the side on which it does not include the thermo-reversible recording layer, etc., of the support 101.

While illustration is omitted, a protective layer may be formed at an uppermost surface layer on the second thermo-reversible recording layer 104 in FIG. 1A, on the second oxygen barrier layer 106 in FIG. 1B, and on the second oxygen barrier layer 106 in FIG. 10.

Support

A shape, structure, size, etc., of the support, for which there is no particular restriction, may be appropriately selected in accordance with a purpose thereof, so that, for example, the shape includes a flat plate shape, etc.; the structure may be a single layer structure or a laminated structure; and the size may be appropriately selected in accordance with a size of the thermo-reversible medium, etc.

A material for the support includes an inorganic material, an organic material, etc., for example.

The inorganic material includes, for example, glass, quartz, silicon, silicon oxide, aluminum oxide, $SiO_2$, metal, etc.

The organic material includes, for example, cellulose derivatives such as cellulose triacetate, paper, films such as polymethyl methacrylate, polystyrene, polycarbonate, polyethylene terephthalate, synthetic paper, etc.

The inorganic material and the organic material may be used alone as one type or two or more types thereof may be used in combination. Among these materials, the organic material is preferable, films such as polymethyl methacrylate, polycarbonate, polyethylene terephthalate, etc., are preferable, and polyethylene terephthalate is particularly preferable.

It is preferable that the support be subjected to surface modification by performing corona discharging, oxidation reaction (chromic acid, etc.), etching, facilitation of adhesion, antistatic treatment, etc., for a purpose of improving adhesiveness of a coating layer.

It is preferable to color the support white by adding white pigments, etc., such as titanium oxide to the support.

A thickness of the support, for which there is no particular restriction, and may be appropriately selected in accordance with a purpose thereof, is preferably between 10 μm to 2000 μm and more preferably between 50 μm and 1000 μm.

First thermo-reversible recording layer and second thermo-reversible recording layer Both a first thermo-reversible recording layer and a second thermo-reversible recording layer (which may be called "a thermo-reversible recording layer" below) are thermo-reversible recording layers which include a leuco dye, which is an electron-donating color-forming compound; and a developer, which is an electron-accepting compound. In the thermo-reversible recording layers, color tone reversibly changes by heat, and a binder resin, and other components are included as needed.

The leuco dye, which is the electron-donating color-forming compound, and a reversible developer, which is the electron-accepting compound, in which leuco dye and reversible developer color tone reversibly changes by heat, are materials which can exhibit a phenomenon in which a visible change reversibly occurs due to a temperature change. The materials can relatively change into a colored state and a decolored state in accordance with a difference in heating temperature, and cooling speed after heating.

Leuco Dye

The leuco dye is a dye precursor which is colorless or pale per se. The leuco dye, for which there is no particular restriction, may be appropriately selected from those known, preferably including, for example, leuco compounds based on triphenylmethane phthalide, triallylmethane, fluoran, phenothiazine, thiofluoran, xanthene, indophthalyl, spiropyran, azaphthalide, chromenopyrazole, methine, rhodamineanilinolactam, rhodaminelactam, quinazoline, diazaxanthene, bislactone, etc. Among these, the leuco dye based on fluoran or phthalide is particularly preferable in that it is superior in coloring and decoloring properties, coloring, storage property, etc. These may be used alone as one type, or two or more types thereof may be used in combination, and layers which develops color with different color tones may be laminated to respond to multi colors or a full color.

Reversible Developer

The reversible developer, for which there is no particular restriction as long as it may reversibly develop and erase color with heat as a cause, may be appropriately selected in accordance with a purpose thereof and preferably includes, for example, a compound having in its molecules at least one structure selected from: (1) a structure having a color developing ability which causes the leuco dye to develop color (for example, a phenolic hydroxyl group, a carboxylic acid group, a phosphoric acid group, etc.); and (2) a structure which controls cohesion among molecules (for example, a structure in which long-chain hydrocarbon groups are linked together). In the linked portion the linking may be via divalent or higher link groups containing a hetero atom. Moreover, the long-chain hydrocarbon groups may also contain therein at least either one of similar link groups and aromatic groups.

For (1) the structure having the color developing ability which causes the leuco dye to develop color, phenol is particularly preferable.

(2) The structure which controls cohesion among molecules is preferably a long-chain hydrocarbon group having at least 8 carbon atoms, is more preferably one having at least 11 carbon atoms, and an upper limit of the number of carbon atoms is preferably less than or equal to 40 and is more preferably less than or equal to 30.

Of the reversible developers, a phenol compound expressed by General Formula (1) is preferable, and a phenol compound expressed by General Formula (2) is more preferable.

CHEM 1

GENERAL FORMULA (1)

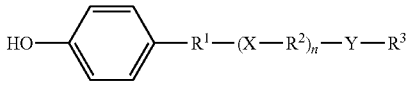

CHEM 2

GENERAL FORMULA (2)

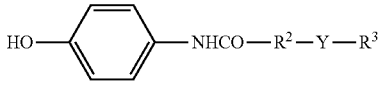

In the General Formula (1) and the General Formula (2), $R^1$ denotes an aliphatic hydrocarbon group having 1 to 24 carbon atoms or a single bond. $R^2$ denotes an aliphatic hydrocarbon group having two or more carbon atoms, which may have a substitution group, and the number of carbon atoms is preferably at least 5, and is more preferably at least 10. $R^3$ denotes an aliphatic hydrocarbon group having 1 to 35 carbon atoms, the number of which carbon atoms is preferably 6 to 35 and is more preferably 8 to 35. The aliphatic hydrocarbon group may be provided alone as one type, or two or more types thereof may be provided in combination.

A sum of the number of carbon atoms of $R^1$, $R^2$ and $R^3$, for which sum there is no particular restriction, may be appropriately selected in accordance with a purpose thereof; a lower limit thereof is preferably at least 8 and is more preferably at least 11, and an upper limit thereof is preferably less than or equal to 40 and is more preferably less than or equal to 35.

When the sum of the number of carbon atoms is less than 8, coloring stability or decoloring properties may degrade. The aliphatic hydrocarbon group, which may be a straight-chain group or a branched-chain group and which may have an unsaturated bond, is preferably the straight-chain group. Moreover, the substitution group bonded to the hydrocarbon group includes, for example, a hydroxyl group, halogen atoms, an alkoxy group, etc.

X and Y may be identical or different, each denoting an N atom-containing or O atom-containing divalent group. Specific examples thereof include oxygen atoms, an amide group, an urea group, a diacylhydrazine group, a diamide oxalate group, and an acylurea group. Of these, the amide group and the urea group are preferable.

n denotes an integer between 0 and 1.

The electron-accepting compound (developer) is preferably used together with a compound as a color erasure accelerator that contains in its molecules at least one of —NHCO— group and —OCONH— group to induce intermolecular interactions between the color erasure accelerator and the developer in a process of forming a decolored state, so that coloring and decoloring properties improve.

The color erasure accelerator, for which there is no particular restriction, may be appropriately selected in accordance with a purpose thereof.

For the thermo-reversible recording layer, a binder resin may be used and, also as needed, various additives for improving or controlling the coating properties and coloring and decoloring properties of the thermo-reversible recording layer may be used. These additives include, for example, a surfactant, a conductive agent, a filling agent, an antioxidant, a light stabilizer, a coloring stabilizer, a color erasure accelerator, etc.

Binder Resin

While the binder resin, for which there is no particular restriction as long as a thermo-reversible recording layer may be bound onto the support, may be appropriately selected in accordance with a purpose thereof, one type of those resins known may be used, or two or more types thereof may be used in combination. Among these, in order to improve the durability at the time of repeating, a resin which can be set by heat, ultraviolet rays, an electron beam, etc., is preferably used, and, in particular, a thermosetting resin in which an isocyanate-based compound, etc., is used as a cross-link agent is preferable. The thermosetting resin includes, for example, a resin having a group which reacts with a cross-link agent, such as a hydroxyl group, a carboxyl group, etc., and a resin produced by copolymerizing a hydroxyl group-containing or carboxyl group-containing monomer and a different monomer. Such a thermosetting resin includes, for example, a phenoxy resin, a polyvinyl butyral resin, a cellulose acetate propionate resin, a cellulose acetate butyrate resin, an acrylpolyol resin, a polyester polyol resin, a polyurethane polyol resin, etc. Of these, an acrylpolyol resin, a polyester polyol resin, and a polyurethane polyol resin are particularly preferable.

The mixture ratio (mass ratio) of the coloring agent to the binder resin in the thermo-reversible recording layer is preferably 0.1 to 10 relative to 1 (the coloring agent). The thermo-reversible recording layer may become deficient in thermal strength when the amount of the binder resin is too small, while a problem may arise that the coloring density decreases when the amount of the binder resin is too large.

The cross-link agent, for which there is no particular restriction, may be appropriately selected in accordance with a purpose thereof and includes, for example, isocyanates, an amino resin, a phenol resin, amines, an epoxy compound, etc. Among these, isocyanates are preferable, and a polyisocyanate compound having multiple isocyanate groups is particularly preferable.

While there is no particular restriction for an amount of the cross-link agent added relative to the amount of the binder resin, a ratio of the number of functional groups in the cross-link agent to the number of active groups contained in the binder resin is preferably between 0.01 to 2. The ratio of less than or equal to 0.01 leads to a deficient thermal strength, and the ratio of greater than or equal to 2 causes an adverse effect on the coloring and decoloring properties.

Moreover, as a cross-link accelerator, a catalyst used in this type of reaction may be used.

A gel fraction of the thermosetting resin when thermally cross-linked, for which there is no particular restriction, is preferably at least 30%, is more preferably at least 50%, and is in particular preferably at 70%. When the gel fraction is less than 30%, a cross-linked state is not adequate, which may lead to a degraded durability.

A coating film may be immersed in a solvent having a high solubility as a method of distinguishing between whether the binder resin is in the cross-linked state or in a non-cross-linked state. In other words, with respect to the binder resin in the non-cross-linked state, the resin dissolves in the solvent, so that it does not remain in a solute.

The other components in the thermo-reversible recording layer, for which there is no particular restriction, and which may be appropriately selected in accordance with a purpose thereof, include, for example, a surfactant, a plasticizer, etc., from a point of view of facilitating recording of an image.

Known methods may be used for a solvent to be used for the thermo-reversible recording layer coating solution, a coating solution dispersing apparatus, an application method, a drying and setting method, etc.

With respect to the thermo-reversible recording layer coating solution, the respective materials may be dispersed in the solvent using the dispersing apparatus, or they may be independently dispersed in the solvent to mix the dispersed results. Moreover, they may be heated and dissolved, and then precipitated by rapid cooling or slow cooling.

The method of forming the thermo-reversible recording layer, for which there is no particular restriction, and which may be appropriately selected in accordance with a purpose thereof, preferably includes, for example, (1) a method of coating, onto a support, a thermo-reversible recording layer coating solution in which the resin, the leuco dye and the reversible developer are dissolved or dispersed in a solvent, and cross-linking the coating solution while or after forming it into a sheet shape, etc., by evaporating the solvent; (2) a method of coating, onto a support, a thermo-reversible recording layer coating solution in which the leuco dye and the reversible developer are dispersed in a solvent in which only the resin is dissolved, and cross-linking the coating solution while or after forming it into a sheet shape, etc., by evaporating the solvent; and (3) a method of, without using a solvent, heating and melting the resin, the leuco dye and the reversible developer so as to mix them together, and cross-linking the melted mixture after forming it into a sheet, etc., to cool it. In these methods, it is also possible to form a sheet-shaped thermo-reversible recording medium without using the support.

The solvent to be used in the above-described method (1) or (2), which may not be unequivocally defined as it depends on the type, etc., of the resin, the leuco dye and the reversible developer, includes, for example, tetrahydrofuran, methyl ethyl ketone, methyl isobutyl ketone, chloroform, carbon tetrachloride, ethanol, toluene, benzene, etc.

The reversible developer is present in the thermo-reversible recording layer, being dispersed in a form of particles.

For a purpose of exhibiting high performance as a coating material, various pigments, an antifoaming agent, a dispersant, a slip agent, an antiseptic agent, a cross-link agent, a plasticizer, etc., may be added to the thermo-reversible recording layer coating solution.

The coating method for the thermo-reversible recording layer, for which there is no particular restriction, may be appropriately selected in accordance with a purpose thereof, so that, a roll-shaped continuous support or a support which is cut into a sheet shape is conveyed, and coating is performed on the support by a known method such as blade coating, wire bar coating, spray coating, air knife coating, bead coating, curtain coating, gravure coating, kiss coating, reverse roll coating, dip coating, die coating, etc., for example.

A drying condition for the thermo-reversible recording layer coating solution, for which there is no particular restriction, and which may be appropriately selected in accordance with a purpose thereof, includes, for example, drying at room temperature to 140° C., for approximately 10 seconds to 10 minutes.

A thickness of the thermo-reversible recording layer, for which there is no particular restriction, and which may be appropriately selected in accordance with a purpose thereof, is, for example, preferably between 1 μm to 20 μm and more preferably between 3 μm and 15 μm. When the thermo-reversible recording layer is too thin, a contrast of an image may decrease as the coloring density decreases. On the other hand, when it is too thick, a heat distribution in the layer increases, a portion which does not reach a coloring temperature and thus does not develop color occurs, and thus a desired coloring density may not be obtained.

A photothermal conversion material can be added to the thermo-reversible recording layer, and, in that case, the photothermal conversion layer and the barrier layer may be omitted, and the first and second thermo-reversible recording layers can be replaced with one thermo-reversible recording layer.

Photothermal Conversion Layer

The photothermal conversion layer contains at least a photothermal conversion material having a function of absorbing the laser light with high efficiency and generating heat. Moreover, for a purpose of suppressing mutual interactions between the thermo-reversible recording layer and the photothermal conversion layer, a barrier layer may be formed therebetween, preferably as a layer with a material having a high thermal conductivity. A layer placed between the thermo-reversible recording layer and the photothermal conversion layer, which may be appropriately selected in accordance with a purpose thereof, is not limited thereto.

The photothermal conversion material may be broadly classified into an inorganic-based material and an organic-based material.

The inorganic-based material, which includes, for example, carbon black, a metal such as Ge, Bi, In, Te, Se, Cr, etc., or a semi-metal thereof, and alloys thereof, lanthanum boride, tungsten oxide, ATO, ITO, etc., is formed into a layer shape by a vacuum evaporation method or by bonding a particulate material with a resin, etc.

As the organic-based material, for which various dyes may be appropriately used in accordance with a wavelength of light to be absorbed, a near-infrared absorbing dye having an absorption peak within a wavelength range of 700 nm to 1,500 nm is used when a semiconductor laser is used as a light source. More specifically, it includes a cyanine dye, a quinine-based dye, a quinoline derivative of indonaphthol, a phenylene diamine-based nickel complexes, a phthalocyanine-based compound, etc. To repeatedly perform image processing, it is preferable to select a photothermal conversion material which is superior in heat resistance, and, in light thereof, is in particular preferably a phthalocyanine-based compound.

The near-infrared absorbing dye may be used alone as one type, or two or more types thereof may be used in combination.

When the photothermal conversion layer is provided, the photothermal conversion material is normally used in combination with a resin. The resin to be used in the photothermal conversion layer, for which there is no particular restriction, may be appropriately selected from among those known in the art as long as it may maintain the inorganic-based material and the organic-based material, and is preferably a thermoplastic resin, a thermosetting resin, etc., so that one similar to the binder resin used in the recording layer may be used preferably. Among these, in order to improve the durability at the time of repeating, a resin which can be set by heat, ultraviolet rays, an electron beam, etc., is preferably used, and a thermal cross-linking resin using an isocyanate-based compound, etc., as a cross-link agent, is particularly preferable. In the binder resin, a hydroxyl value thereof is preferably 50 mgKOH/g to 400 mgKOH/g.

A thickness of the photothermal conversion layer, for which there is no particular restriction, and which may be appropriately selected in accordance with a purpose thereof, is preferably 0.1 μm to 20 μm.

First Oxygen Barrier Layer and Second Oxygen Barrier Layer

As first and second oxygen barrier layers (which may be called simply an oxygen barrier layer), it is preferable to provide an oxygen barrier layer above and below the first thermo-reversible recording layer and the second thermo-reversible recording layer for a purpose of preventing oxygen from entering the thermo-reversible recording layer to prevent photo-deterioration of the leuco dye within the first and second thermo-reversible recording layers. In other words, it is preferable to provide the first oxygen barrier layer between the support and the first thermo-reversible recording layer and to provide the second oxygen barrier layer above the second thermo-reversible recording layer.

Materials for forming the first and second oxygen barrier layers, for which there is no particular restriction thereof, and which may be appropriately selected in accordance with a purpose thereof, includes a resin, a polymer film, etc., with a large transmittance of a visible portion thereof and a low oxygen permeation. The oxygen barrier layer is selected in accordance with the use thereof, oxygen permeation, transparency, ease of coating, adhesiveness, etc.

Specific examples of the oxygen barrier layer include a silica deposited film, an alumina deposited film, and a silica-alumina deposited film, in all of which inorganic oxide is vapor deposited on a polymer film such as polyethylene terephthalate, nylon, etc., or a resin such as nylon-6, polyacetal, etc., polyacrylic acid alkyl esters, polymethacrylic acid alkyl esters, polymethacrylonitrile, polyalkylvinyl ester, polyalkylvinyl ether, polyvinyl fluoride, polystyrene, an acetic acid-vinyl copolymer, cellulose acetate, polyvinyl alcohol, polyvinylidene chloride, an acetonitrile copolymer, a vinylidene chloride copolymer, poly(chlorotrifluoroethylene), an ethylene-vinyl alcohol copolymer, polyacrylonitrile, an acrylonitrile copolymer, polyethylene terephthalate, etc. Among them, the film in which the inorganic oxide is vapor deposited on the polymer film is preferable.

The oxygen permeability of the oxygen barrier layer, for which there is no restriction, is preferably less than or equal to 20 $ml/m^2/day/MPa$ or less, is more preferably less than or equal to 5 $ml/m^2/day/MPa$, and is, in particular, preferably less than or equal to 1 $ml/m^2/day/MPa$. When the oxygen permeability thereof exceeds 20 $ml/m^2/day/MPa$, the photo-deterioration of the leuco dye within the first and second thermo-reversible recording layers may not be suppressed.

The oxygen permeability may be measured by a measuring method which conforms to a JIS K7126 B method, for example.

The oxygen barrier layers may be formed so as to place the thermo-reversible recording layer therebetween, such as on the lower side of the thermo-reversible recording layer or on the back face of the support. In this way, an entry of oxygen into the thermo-reversible recording layer may be more effectively prevented, making it possible to reduce the photodeterioration of the leuco dye.

A method of forming the first and second oxygen barrier layers, for which there is no particular restriction, and which may be appropriately selected in accordance with a purpose thereof, includes melt extrusion, coating, laminating, etc.

A thickness of the first and second oxygen barrier layers, which varies depending on the oxygen permeability of the resin or the polymer film, is preferably 0.1 μm to 100 μm. When it is less than 0.1 μm, the oxygen barrier properties are insufficient, while, when it is more than 100 μm, it is not preferable as the transparency thereof decreases.

An adhesive layer may be provided between the oxygen barrier layer and an underlying layer. The method of forming the adhesive layer, for which there is no particularly restriction, may include normal methods of coating, laminating, etc. The thickness of the adhesive layer, for which there is no particular restriction, is preferably 0.1 μm to 5 μm. The adhesive layer may be set with a cross-link agent. For the cross-link agent, the same one as that used in the thermo-reversible recording layer may be used preferably.

Protective Layer

In the thermo-reversible recording medium of the present invention, it is preferable to provide a protective layer on the thermo-reversible recording layer for a purpose of protecting the thermo-reversible recording layer. The protective layer, for which there is no restriction, may be appropriately selected in accordance with a purpose thereof, and, for example, may be formed of one or more layers, and is preferably provided on an outermost surface which is exposed.

The protective layer contains a binder resin and also, as needed, contains other components such as a filler, a lubricant, coloring pigments, etc.

The binder resin of the protective layer, for which there is no restriction, may be appropriately selected in accordance with a purpose thereof, is preferably a thermosetting resin, an ultraviolet (UV) setting resin, an electron beam setting resin, etc., and, of these, is, in particular, preferably an ultraviolet (UV) setting resin or a thermosetting resin.

With the UV setting resin, a very hard film may be formed after setting, and damage due to a physical contact of a surface and deforming of the medium caused by laser heating may be suppressed, so that a thermo-reversible recording medium which is superior in repetition durability is obtained.

Moreover, while being slightly inferior to the UV setting resin, the thermosetting resin may similarly set the surface and is superior in repetition durability.

The UV setting resin, for which there is no particular restriction, may be appropriately selected in accordance with a purpose thereof from what is known and includes, for example, oligomers based on urethane acrylates, epoxy acrylates, polyester acrylates, polyether acrylates, vinyls and unsaturated polyesters; and monomers such as various monofunctional and multifunctional acrylates, methacrylates, vinyl esters, ethylene derivatives, allyl compounds, etc. Of these, multifunctional, i.e., tetrafunctional or higher, monomers or oligomers are particularly preferable. Two or more types of these monomers or oligomers may be mixed to appropriately adjust the hardness, degree of contraction, flexibility, coating strength, etc., of the resin film.

In order to set the monomers or the oligomers with ultraviolet rays, it is necessary to use a photopolymerization initiator or a photopolymerization accelerator.

An amount of the photopolymerization initiator or the photopolymerization accelerator added, for which there is no particular restriction, is preferably 0.1 mass % to 20 mass %, and is more preferably 1 mass % to 10 mass %, relative to a total mass of the resin component of the protective layer.

Ultraviolet irradiation for setting the ultraviolet setting resin, which may be performed using a known ultraviolet irradiating apparatus, includes, for example, one provided with a light source, a lamp, a power supply, a cooling apparatus, a conveying apparatus, etc.

The light source includes, for example, a mercury lamp, a metal halide lamp, a potassium lamp, a mercury-xenon lamp, a flash lamp, etc. A wavelength of the light source may be appropriately selected in accordance with the ultraviolet absorption wavelength of the photopolymerization initiator and the photopolymerization accelerator added to the thermo-reversible recording medium composition.

Conditions for the ultraviolet irradiation, for which there is no particular restriction, may be appropriately selected in accordance with a purpose thereof, so that, for example, it suffices to determine a lamp output, a conveying speed, etc., in accordance with irradiating energy which is necessary to cross link the resin.

Moreover, in order to improve the conveyability, a releasing agent such as zinc stearate, or wax; a silicone-grafted polymer, or a silicone having a polymerizable group; or a lubricant such as silicone oil, etc., may be added. An amount of these added is preferably 0.01 mass % to 50 mass % and is more preferably 0.1 mass % to 40 mass %, relative to a total mass of the resin component of the protective layer. These may be used alone as one type, or two or more types may be used together. Moreover, as a countermeasure for static electricity, a conductive filler is preferably used and a needle-shaped conductive filler is preferably used in particular.

A particle diameter of the filler, for which there is no particular restriction, is, for example, preferably 0.01 μm to 10.0 μm and is more preferably 0.05 μm to 8.0 μm. An amount of the filler added is preferably 0.001 mass parts to 2 mass parts and is more preferably 0.005 mass parts to 1 mass part, relative to 1 mass part resin.

The protective layer may contain a surfactant, a leveling agent, an antistatic agent, etc., that are known in the prior art as an additive.

Moreover, as the thermosetting resin, one similar to the binder resin used for the thermo-reversible recording layer may be used preferably, for example.

The thermosetting resin is preferably cross linked. Accordingly, the thermosetting resin is preferably one having a group which reacts with a setting agent, such as a hydroxyl group, an amino group, a carboxyl group, etc., and is, in particular, preferably a hydroxyl group-containing polymer. In order to improve the strength of a polymer-containing layer having the ultraviolet absorbing structure, a polymer having a hydroxyl value of at least 10 mgKOH/g leads to obtaining a sufficient coating strength, is more preferably at least 30 mgKOH/g, and is further preferably at least 40 mgKOH/g. The protective layer may be made to have a sufficient coating strength to prevent deterioration of the thermo-reversible recording medium even when image recording and erasure are performed repeatedly.

For the setting agent, for which there is no particular restriction, one similar to the setting agent used for the thermo-reversible recording layer may be used preferably, for example.

As a solvent used for the protective layer coating solution, a dispersing apparatus for the coating solution, a protective layer applying method, a drying method, etc., for which there is no particular restriction, a known method used for the recording layer may be used. When an ultraviolet setting resin is used, a setting step by means of ultraviolet irradiation with which coating and drying are performed is required, in which case an ultraviolet irradiating apparatus, a light source, and irradiating conditions are as described above.

A thickness of the protective layer, for which there is no particular restriction, is preferably 0.1 μm to 20 μm, is more preferably 0.5 μm to 10 μm, and, in particular, preferably 1.5 μm to 6 μm. When the thickness is less than 0.1 μm, the protective layer may not adequately perform a function as a protective layer of the thermo-reversible recording medium, the thermo-reversible recording medium easily deteriorates through heat repeating history, and thus it may become not possible to be repeatedly used. When the thickness exceeds 20 μm, it is impossible to conduct adequate heat to a thermo-sensitive portion located at a lower layer portion of the protective layer, and thus it may become not possible to adequately perform recording and erasure of an image by heat.

Ultra-Violet Absorbing Layer

For the thermo-reversible recording medium, it is preferable to provide an ultraviolet absorbing layer for a purpose of preventing non-erasure due to photo-deterioration and coloring by ultraviolet rays of the leuco dye within the thermo-reversible recording layer, which makes it possible to improve the light resistance of the recording medium. It is preferable that a thickness of the ultraviolet absorbing layer be appropriately selected such that it absorbs ultraviolet rays of less than or equal to 390 nm.

The ultraviolet absorbing layer contains at least a binder resin and an ultraviolet absorber and also, as needed, contains other components such as a filler, a lubricant, coloring pigments, etc.

The binder resin, for which there is no particular restriction, may be appropriately selected in accordance with a purpose thereof and, as the binder resin, a resin component such as a thermosetting resin, a thermoplastic resin, a binder resin of the thermo-reversible recording layer, etc., may be used. The resin component includes, for example, polyethylene, polypropylene, polystyrene, polyvinyl alcohol, polyvinyl butyral, polyurethane, saturated polyester, unsaturated polyester, an epoxy resin, a phenol resin, polycarbonate, polyamide, etc.

As the ultraviolet absorber, one of the organic-based compound and the inorganic-based compound may be used.

Moreover, it is preferable to use a polymer having an ultraviolet absorbing structure (which may be called "an ultraviolet absorbing polymer" below).

Here, the polymer having the ultraviolet absorbing structure means a polymer having an ultraviolet absorbing structure (e.g., an ultraviolet absorbing group) in a molecule thereof. The ultraviolet absorbing structure includes, for example, a salicylate structure, a cyanoacrylate structure, a benzotriazol structure, a benzophenone structure, etc., among which the benzotriazol structure and the benzophenone structure are particularly preferable as they absorb the ultraviolet rays having a wavelength of 340 nm to 400 nm, which is a cause of photo-deterioration of the leuco dye.

The ultraviolet absorbing polymer is preferably cross linked. Therefore, for the ultraviolet absorbing polymer, one having a group which reacts with a setting agent, such as hydroxyl group, amino group, carboxyl group, etc., is preferably used and, in particular, a polymer having a hydroxyl group is preferable. In order to increase a physical strength of a polymer-containing layer having the ultraviolet absorbing structure, a sufficient coating film strength is obtained by using a polymer having a hydroxyl value of at least 10 mgKOH/g, which hydroxyl value is more preferably at least 30 mgKOH/g and further preferably at least 40 mgKOH/g. It may be made to have a sufficient coating strength to prevent deterioration of the recording medium even when erasure and printing are performed repeatedly.

A thickness of the ultraviolet absorbing layer, for which there is no particular restriction, is preferably 0.1 μm to 30 μm and more preferably 0.5 μm to 20 μm. For a solvent used for the ultraviolet absorbing layer coating solution, a dispersing apparatus for the coating solution, an ultraviolet absorbing layer applying method, an ultraviolet absorbing layer drying and cutting method, etc., for which there is no particular restriction, a known method used for the thermo-reversible recording layer may be used.

Intermediate Layer

As the thermo-reversible recording medium, for which there is no particular restriction, it is preferable to provide an intermediate layer between the thermo-reversible recording layer and the protective layer for the purpose of improving adhesiveness between the thermo-reversible recording layer and the protective layer, preventing change in the quality of the thermo-reversible recording layer due to application of the protective layer, and preventing the additives in the protective layer from being transferred to the recording layer. This makes it possible to improve the maintenability of a colored image.

The intermediate layer, for which there is no particular restriction, includes one containing at least a binder resin and also includes, as needed, one containing a different component such as a filler, a lubricant, coloring pigments, etc. The binder resin, for which there is no particular restriction, may be appropriately selected in accordance with a purpose thereof and, as the binder resin, a resin component such as a thermosetting resin, a thermoplastic resin, a binder resin of the thermo-reversible recording layer, etc., may be used. The resin component includes, for example, polyethylene, polypropylene, polystyrene, polyvinyl alcohol, polyvinyl butyral, polyurethane, saturated polyester, unsaturated polyester, an epoxy resin, a phenol resin, polycarbonate, polyamide, etc.

Moreover, the intermediate layer preferably contains an ultraviolet absorber. As the ultraviolet absorber, one of the organic-based compound and the inorganic-based compound may be used.

Moreover, an ultraviolet absorbing polymer may be used, or cutting may be performed by a cross-link agent. For these, the same one as that used in the protective layer may be used preferably.

A thickness of the intermediate layer is preferably 0.1 μm to 20 μm and more preferably 0.5 μm to 5 μm. For a solvent used for the intermediate layer coating solution, a dispersing apparatus for the coating solution, an intermediate layer applying method, an intermediate layer drying and cutting method, etc., a known method used for the thermo-reversible recording layer may be used.

Under Layer

As the thermo-reversible recording medium, for which there is no particular restriction, an under layer may be provided between the thermo-reversible recording layer and the support for the purpose of effectively utilizing applied heat and achieving high sensitivity, or improving adhesiveness between the support and the thermo-reversible recording layer, and preventing permeation of a recording layer material into the support.

The under layer includes one containing at least hollow particles and one containing a binder resin and also, as needed, containing other components.

The hollow particles include single hollow particles in which only one hollow portion exists within a particle, and multi hollow particles in which a large number of hollow portions exist in a particle. Of these, one type may be used alone, or two more types may be used in combination.

A material for the hollow particles, for which there is no restriction, may be appropriately selected in accordance with the purpose thereof, and preferably includes a thermoplastic resin, etc., for example. The hollow particles may be appropriately manufactured, or they may be a commercially available product. The commercially available product includes MICROSPHERE-R-300 (manufactured by Matsumoto Yushi-Seiyaku Co., Ltd.); ROPAQUE HP1055 and ROPAQUE HP433J (both of which are manufactured by Zeon Corporation); SX866 (manufactured by JSR Corporation), etc., for example.

An amount of the hollow particles added to the under layer, for which there is no particular restriction, is appropriately selected in accordance with the purpose thereof, and is preferably 10 mass % to 80 mass %, for example.

As the binder resin, a resin similar to one used for the thermo-reversible recording layer or used for the polymer-containing layer having the ultraviolet absorbing structure may be used.

The under layer may contain at least one of various organic fillers and an inorganic filler such as calcium carbonate, magnesium carbonate, titanium oxide, silicon oxide, aluminum hydroxide, kaolin, talc, etc.

The under layer may also contain a lubricant, a surfactant, a dispersant, etc.

A thickness of the under layer, for which there is no particular restriction, may be appropriately selected in accordance with a purpose thereof, and is preferably 0.1 μm to 50 μm, is more preferably 2 μm to 30 μm, and is, in particular, preferably 12 μm to 24 μm.

Back Layer

As the thermo-reversible recording medium, for which there is no particular restriction, a back layer may be provided at the support on the opposite side of a face on which the thermo-reversible recording layer is formed for the purpose of preventing curl and static charge and improving the conveyability.

The back layer, for which there is no particular restriction, includes one containing at least a binder resin and also includes, as needed, one containing a different component such as a filler, a conductive filler, a lubricant, coloring pigments, etc.

The binder resin of the protective layer, for which there is no restriction, may be appropriately selected in accordance with the purpose thereof, and includes, for example, a thermosetting resin, an ultraviolet (UV) setting resin, an electron beam setting resin, etc., and, of these, is, in particular, preferably the ultraviolet (UV) setting resin or the thermosetting resin.

For the ultraviolet setting resin, the thermosetting resin, the filler, the conductive filler, and the lubricant, one similar to one used for the thermo-reversible recording layer or the protective layer may be used preferably.

Adhesive Layer and Tackiness Layer

An adhesive layer or a tackiness layer may be provided on a face opposite the recording layer forming face of the support to obtain the thermo-reversible medium in a mode of a thermo-reversible recording label.

A material for the adhesive layer and the tackiness layer, for which there is no particular restriction, may be appropriately selected in accordance with the purpose thereof from what are commonly used.

The material for the adhesive layer and the tackiness layer may be of a hot-melt type. Moreover, release paper may used, or non-release type paper may be used. In this way, the adhesive layer or the tackiness layer may be provided to paste the recording layer to the whole face or a part of a thick substrate such as a magnetic stripe-attached vinyl chloride card, on which it is difficult to apply the recording layer. This makes it possible to improve the convenience of the thermo-reversible medium, such as an ability to display a part of magnetically stored information.

The thermo-reversible recording label provided with such an adhesive layer or a tackiness layer is also preferable for a thick card such as an IC card, an optical card, etc.

Coloring Layer

In the thermo-reversible recording medium, a coloring layer may be provided between the support and the recording layer for the purpose of improving visibility.

The coloring layer may be formed by applying and drying a dispersion solution or a solution containing a colorant and a resin binder on a target face, or it may be formed simply by affixing a coloring sheet thereto.

The coloring layer may be made to be a color printing layer.

A colorant in the color printing layer includes, for example, various dyes, pigments, etc, that are contained in a color ink used for conventional full-color printing.

The resin binder includes various resins including a thermoplastic resin, a thermosetting resin, an ultraviolet setting resin, an electron beam setting resin, etc.

A thickness of the color printing layer, for which there is no restriction, may be appropriately selected in accordance with a desired printed color density since it is appropriately changed relative to a printing color density.

In the thermo-reversible recording medium, an irreversible recording layer may be used. In this case, color tones of the respective recording layers may be identical or different.

Moreover, a coloring layer on which is formed an arbitrary pictorial design, etc., by offset printing, gravure printing, etc., or by an ink-jet printer, a thermal transfer printer, a sublimation printer, etc., may be provided on a portion of the opposite face or on the whole or a part of the same face as the recording layer of the thermo-reversible recording medium, and also an OP varnish layer with a cutting resin as a main component may be provided on the whole or a part of the coloring layer.

The pictorial design includes, for example, characters, patterns, diagrams, photographs, information detected with infrared rays, etc.

Moreover, any of the respective layers that are simply formed may be colored by adding dyes or pigments thereto.

Furthermore, the thermo-reversible recording medium may be provided with a hologram for security. Moreover, to provide a design effect, it may also be provided with a design such as a portrait, a company emblem, a symbol, etc., by forming depressions and protrusions in relief or in intaglio.

Shape and Use of Thermo-Reversible Recording Medium

The thermo-reversible recording medium may be formed into a desired shape in accordance with use thereof, so that it is formed into a card shape, a tag shape, a label shape, a sheet shape, a roll shape, etc., for example.

Moreover, the thermo-reversible recording medium formed into the card may be used for a prepaid card, a discount card (i.e., a so-called point card), a credit card, etc.

The thermo-reversible recording medium formed into a shape of a tag which is smaller in size than the card may be used for a price tag, etc., while the thermo-reversible recording medium formed into a shape of a tag which is larger in size than the card may be used for tickets, process control and shipping instructions, etc.

The thermo-reversible recording medium formed into the label may be affixed, so that it may be formed into a variety of sizes and may be affixed to a cart, a receptacle, a box, a container, etc., which are repeatedly used, so as to be used for process control and article control, etc. Moreover, the thermo-reversible recording medium formed into a sheet which is larger in size than the card provides a wider range for recording, so that it may be used for general purpose documents, process control instructions, etc.

Example of Combining Thermo-Reversible Recording Medium with RF-ID

The thermo-reversible recording member is superior in convenience as the thermo-reversible recording layer (the recording layer) which is capable of reversible displaying, and an information storage unit are (integrally) provided on the same card or tag, and a part of information stored in the information storage unit is displayed on the recording layer, making it possible to check the information by simply examining a card or a tag without requiring a special apparatus. Moreover, when content of the information storage unit is rewritten, a display of the thermo-reversible recording unit may be rewritten to repeatedly use the thermo-reversible recording medium many times.

The information storage unit, for which there is no particular restriction, may be appropriately selected in accordance with the purpose thereof and preferably includes a magnetic recording layer, a magnetic stripe, an IC memory, an optical memory, an RF-ID tag, etc., for example. For use in process control, article control, etc., the RF-ID tag may be preferably used in particular.

The RF-ID tag includes an IC chip, and an antenna connected to the IC chip.

The thermo-reversible recording member includes the recording layer capable of reversible displaying; and the information storage unit, a preferable example of which include the RF-ID tag.

Figure 8:
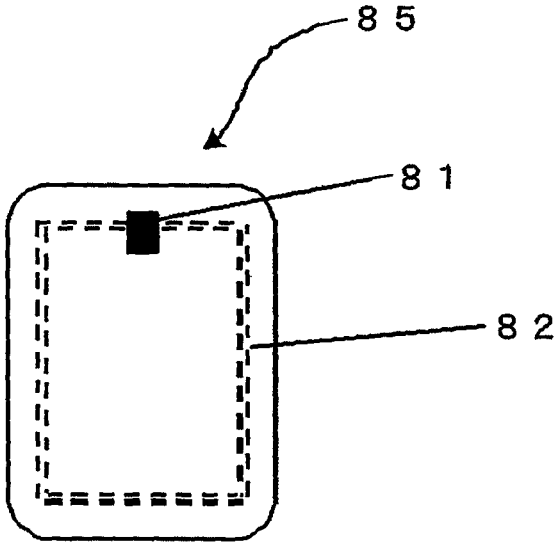
FIG. 8 is a schematic explanatory diagram illustrating an example of an RF-ID tag.

FIG. 8 shows an example of a schematic view of the RF-ID tag. The RF-ID tag 85 includes an IC chip 81; and an antenna 82 connected to the IC chip 81. The IC chip 81 is divided into four units, i.e., a storage unit, a power adjusting unit, a transmitting unit, and a receiving unit, each serving an allotted role to conduct communications. As for the communications, the RF-ID tag 85 communicates with an antenna of a reader/writer via radio waves to exchange data. More specifically, there are two types of methods, i.e., an electromagnetic induction method in which the antenna of the RF-ID tag 85 receives radio waves from the reader/writer, and electromotive force is generated by electromagnetic induction caused by resonance; and a radio wave method in which activation is made by a radiated electromagnetic field. In both methods, the IC chip 81 within the RF-ID tag 85 is activated by an electromagnetic field from outside, information within the chip is converted to a signal, and then the signal is emitted from the RF-ID tag 85. The information is received by the antenna on the reader/writer side and recognized by a data processing unit, and data processing is performed on the software side.

The RF-ID tag, which is formed into a label shape or a card shape, may be affixed to the thermo-reversible recording medium. The RF-ID tag, which may be affixed to the recording layer face or the back layer face, is preferably affixed to the back layer face.

To affix the RF-ID tag to the thermo-reversible recording medium, a known adhesive or tackiness agent may be used.

Moreover, the thermo-reversible recording medium and the RF-ID tag may be integrally formed by lamination, etc., to form a card shape or a tag shape.

An example of use in process control of the thermo-reversible recording member in which the thermo-reversible recording medium and the RF-ID tag are combined is shown.

A process line on which a container containing a delivered raw material is conveyed is provided with a unit which writes, in a non-contact manner, a visible image on a display unit while being conveyed, and a unit which performs erasing in a non-contact manner, and is further provided with a reader/writer for performing non-contact reading and rewriting of information in the RF-ID provided in the container by transmission of electromagnetic waves. Moreover, the process line is also provided with a control unit which uses individual information of containers that is written or read out in a non-contact manner while the containers are being conveyed to automatically perform sorting, weighing, managing, etc., on a distribution line.

For the RF-ID tag-equipped thermo-reversible recording medium attached to the container, inspection is carried out by recording information such as an article name, quantity, etc., on the thermo-reversible recording medium and the RF-ID tag. In the next process, instructions are given to process the raw material delivered, information for processing is recorded on the thermo-reversible recording medium and in the RF-ID tag, generating processing instructions and proceeding to the processing process. Next, order information is recorded on the thermo-reversible recording medium and the RF-ID tag as order instructions for the processed product, shipping information is read from a collected container after product shipment, and the container and the thermo-reversible recording medium with the RF-ID tag are used again for delivery.

At this time, with non-contact recording onto the thermo-reversible recording media using a laser, erasing/recording of information may be performed without peeling off the thermo-reversible recording medium from the container, etc., and also, with an ability to also store information in the RF-ID tag in a non-contact manner, the process may be managed in real time and information within the RF-ID tag can be displayed on the thermo-reversible recording medium simultaneously.

Image Recording and Image Erasing Mechanism

The mechanism of image recording and image erasing is a mode in which a color tone reversibly changes with heat. In the mode, which includes leuco dyes and a reversible developer (called "a developer" below), the color tone reversibly changes with heat to transparent and colored states.

Figure 2A:
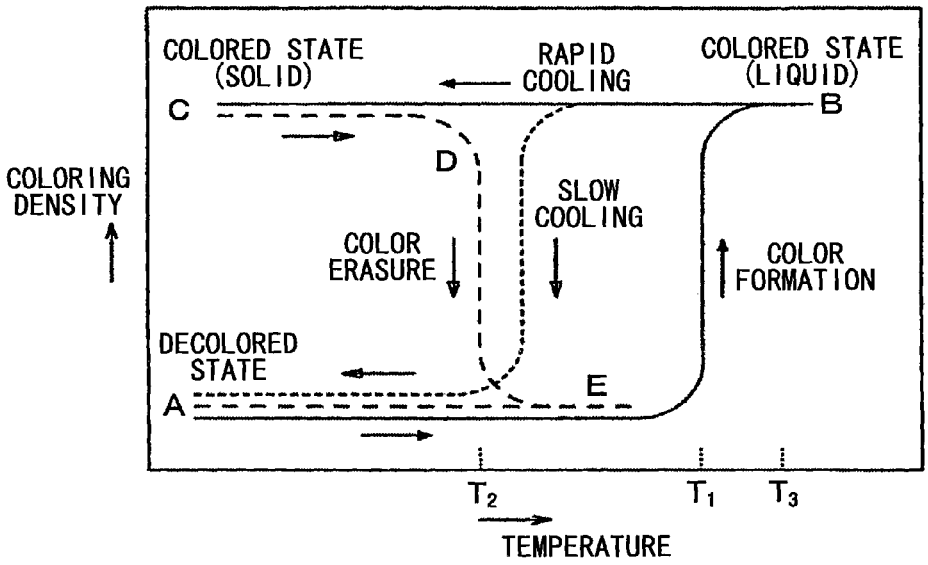
Figure 2B:
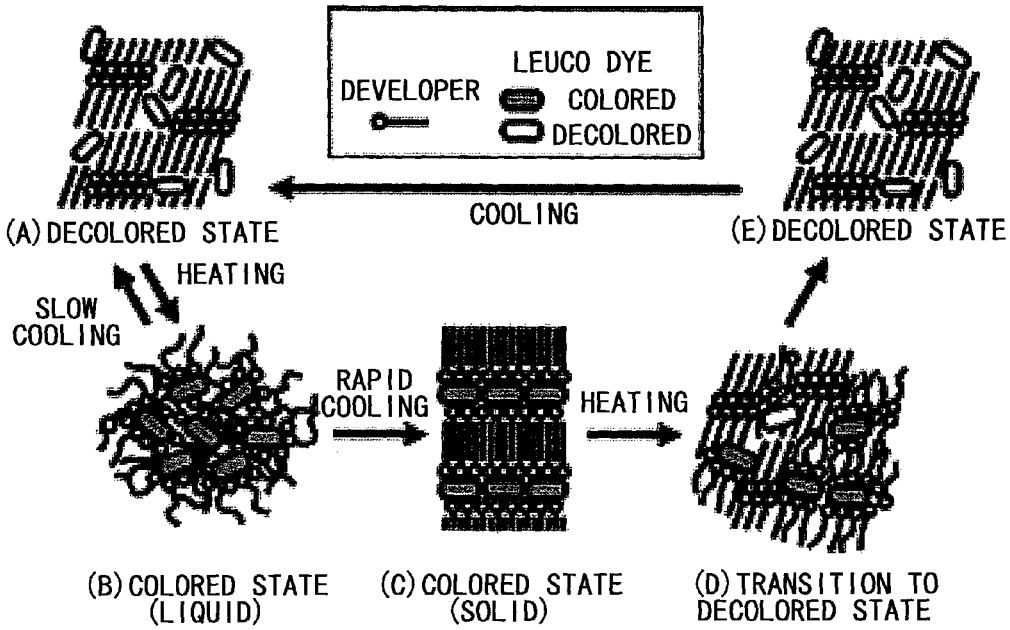
FIG. 2B is a schematic explanatory diagram showing a mechanism of color formation-color erasure changes of the thermo-reversible recording medium.

FIG. 2A shows an example of a temperature-coloring density changing curve for a thermo-reversible recording medium which has a thermo-reversible recording layer including the leuco dyes and the developer in the resin, while FIG. 2B shows a coloring and decoloring mechanism of the thermo-reversible recording medium such that a transparent state and a coloring state reversibly change with heat.

First, when a temperature of the thermo-reversible recording layer, which is initially in a decolored state (A), is increased, at a fusing temperature $T_1$, the leuco dyes and the developer fuse together, coloring occurs, leading to a fused colored state (B). When rapidly cooled from the fused colored state (B), it is possible to lower to room temperature while being in the colored state, so that the colored state is stabilized to lead to a fixed colored state (C). Whether the colored state is obtained depends on a temperature lowering speed from the fused state, so that decoloring occurs in the process of decreasing temperature with slow cooling, leading to a state of low density relative to the colored state (C) by rapid cooling, or the decolored state (A), which is the same as an initial state. On the other hand, when temperature is raised again from the colored state (C), decoloring (from D to E) occurs at a temperature $T_2$, which is lower than a coloring temperature;

lowering temperature from this state causes a transition back to the decolored state (A), which is the same as an initial state.

The colored state (C), which is obtained by rapidly cooling from the fused state is a state where the leuco dyes and the developer are mixed such that their molecules may undergo contact reaction, which is often a solid state. This is a state in which a fused mixture (the coloring mixture) of the leuco dyes and the developer crystallizes to maintain color, and it is believed that coloring is stabilized by the formation of this structure. On the other hand, the decolored state is where both are phase-separated. It is believed that this is a state in which molecules of at least one of the compounds gather to form a domain or they are crystallized, and gathering or crystallizing causes the leuco dyes and the developer to separate to stabilize. In this way, in many cases, both are phase separated, so that the developer crystallizes, causing more complete decoloring to occur.

In both decoloring due to slow cooling from the fused state and decoloring due to a rise in temperature from the colored state that are shown in FIG. 2A, a gathering structure changes at $T_2$, causing crystallizing of the developer and phase separation to occur.

Moreover, in FIG. 2A, when a temperature of the recording layer is repeatedly increased to a temperature $T_3$, which is greater than or equal to a fusing temperature $T_1$, an erasing failure may occur in which erasing is not possible even when heated to an erasing temperature. It is believed that this is due to the developer undergoing thermal decomposition, making it difficult for the developer to undergo gathering or crystallizing and separate from the leuco dyes. For suppressing deterioration of the thermo-reversible recording medium by repeating, a difference between the temperature $T_3$ and the fusing temperature $T_1$ in FIG. 2A when heating the thermally reversible recording medium is reduced to suppress deterioration of the thermo-reversible recording medium by repeating.

Now, a description is given with regard to an embodiment of the image erasing apparatus of the present invention with reference to the drawings.

Figure 3A:
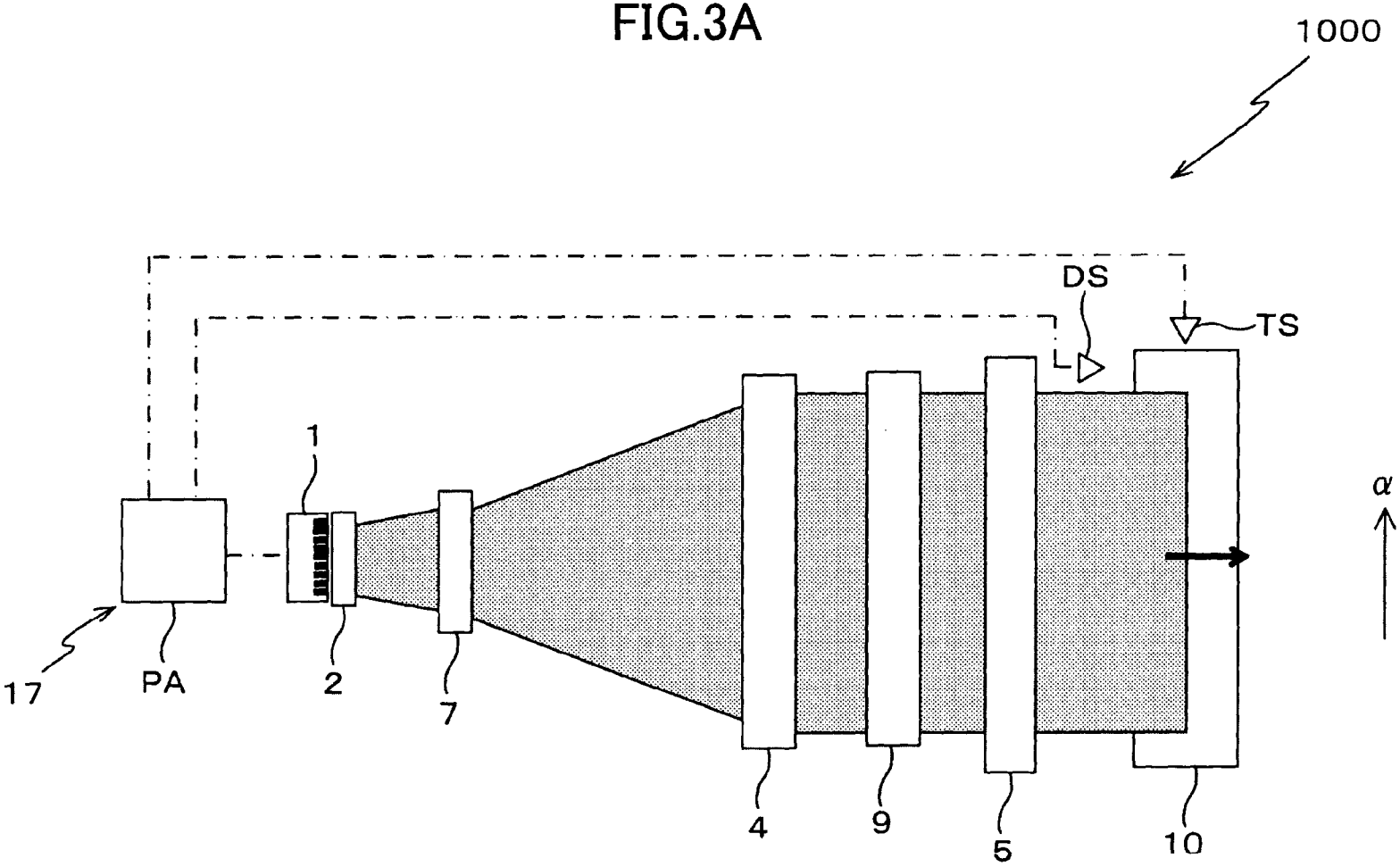
FIGS. 3A and 3B are a first part and a second part of a diagram for explaining an example of an image erasing apparatus of the present invention.
Figure 3B:
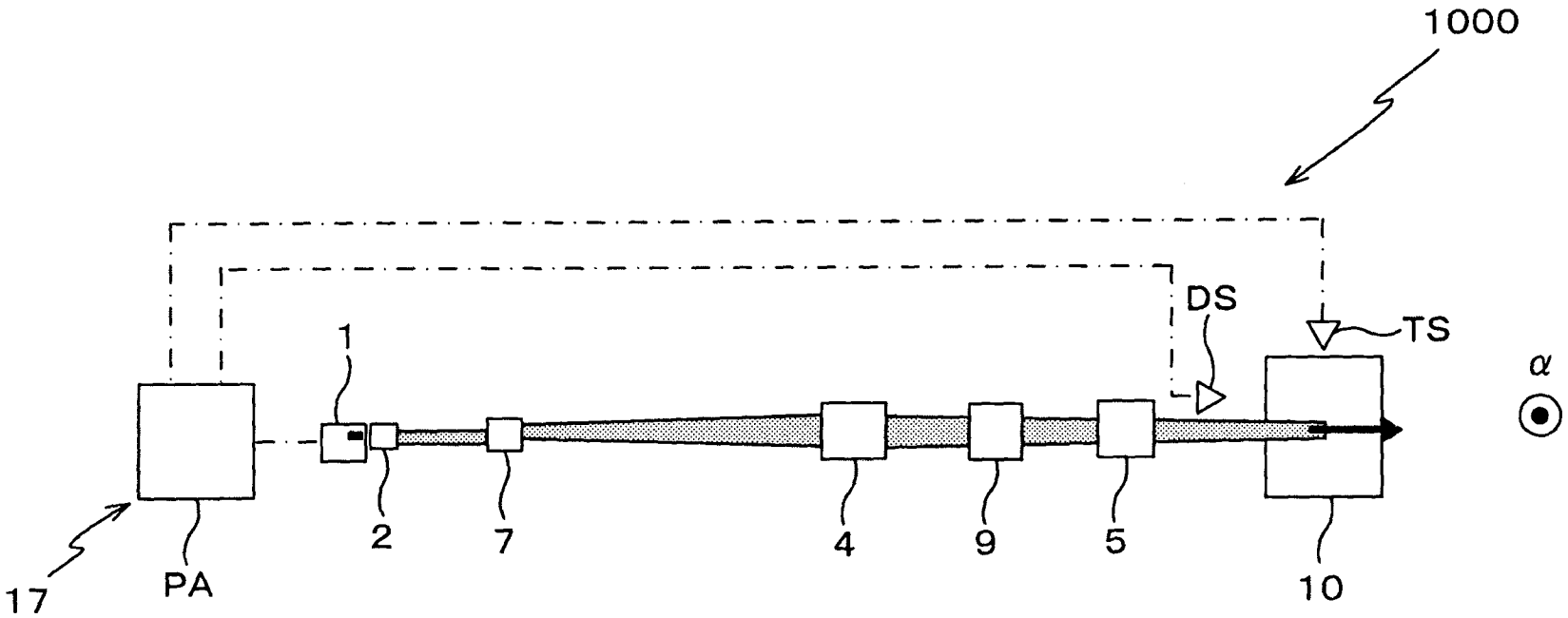

As shown in FIGS. 3A and 3B, the image erasing apparatus 1000 of the present embodiment includes an LD array 1, a width direction parallelizing unit 2, a length direction light distribution uniformizing unit 7, a length direction parallelizing unit 4, a length direction converging unit 9, a scanning unit 5, and an irradiating energy amount control unit 17.

As the LD array 1, an LD array in which multiple LDs (semiconductor lasers) are aligned in a mono-axial direction (an α-axis direction) is used.

As the width direction parallelizing unit 2, an optical lens which converges a line-shaped laser light (a line-shaped beam) emitted from the LD array 1 in a width direction is used.

The length direction light distribution uniformizing unit 7 has a function of uniformly dispersing a line-shaped beam which passed through the width direction parallelizing unit 2 in a length direction (the a axis direction) to uniformize light distribution in the length direction of the line-shaped beam.

As the length direction parallelizing unit 4, an optical lens is used which parallelizes in the length direction the line-shaped beam which passed through the length direction light distribution uniformizing unit 7.

As the width direction converging unit 9, an optical lens is used which converts a line-shaped beam which passed through the length direction parallelizing unit 4 into a converging light which converges in the width direction.

As the scanning unit 5, (1) laser light scanning by a mono-axial galvano mirror may finely realize scanning control, but at a high cost; (2) laser scanning by a stepper motor mirror may finely realize scanning control at a lower cost compared to the galvano mirror; (3) laser light scanning by a polygon mirror may be performed only at a constant speed, but at a low cost.

Moreover, in addition to deflecting by the scanning unit 5, a thermo-reversible recording medium 10 may also be moved. As a method of realizing, (1) the thermo-reversible recording medium 10 is moved with a stage; or (2) the thermo-reversible recording medium 10 is moved with a conveyor (the medium is affixed to a box, which is moved with the conveyor).

The irradiating energy amount control unit 17 is used which includes a temperature sensor TS which measures a temperature of the thermo-reversible recording medium 10 or the surrounding thereof; a distance sensor DS which measures a distance between the thermo-reversible recording medium 10 and the scanning unit 5; and an output adjusting apparatus PA which adjusts an output of the one-dimensional LD array 1 based on a measured value of the temperature sensor TS and the distance sensor DS.

In this way, irradiating energy which is suitable for erasing an image may be irradiated onto the thermo-reversible recording medium 10 regardless of a temperature of the thermo-reversible recording medium 10 and a distance between the thermo-reversible recording medium 10 and the scanning unit 5.

In this case, the output adjusting apparatus PA adjusts an output of the LD array 1 based on measured values of the temperature sensor TS and the distance sensor DS, taking into account the above-described coloring-decoloring characteristics of the thermo-reversible recording medium 10.

The irradiating energy amount control unit 17 does not have to include the temperature sensor TS or the distance sensor DS. In other words, the output adjusting apparatus PA may adjust the output of the LD array 1 based on the measured value of the temperature sensor TS or the distance sensor DS.

In lieu of the output adjusting apparatus PA, the irradiating energy amount control unit 17 may include a heating time adjusting apparatus which adjusts a heating time of the thermo-reversible medium 10 based on a measured value of at least one of the temperature sensor TS and the distance sensor DS.

When the line-shaped beam is deflected (scanned) in the width direction to perform erasing, the heating time may be denoted as W/V using a beam width W and a scanning speed V, where W/V is desirably constant as much as possible in order to realize uniform erasing.

However, it is difficult from an apparatus cost aspect to control V in accordance with a proceeding direction of the line-shaped beam, so that it is desirable to control W in accordance with the proceeding direction of the line-shaped beam. More specifically, W may be controlled to be constant as much as possible while making V constant, for example.

Figure 4A:
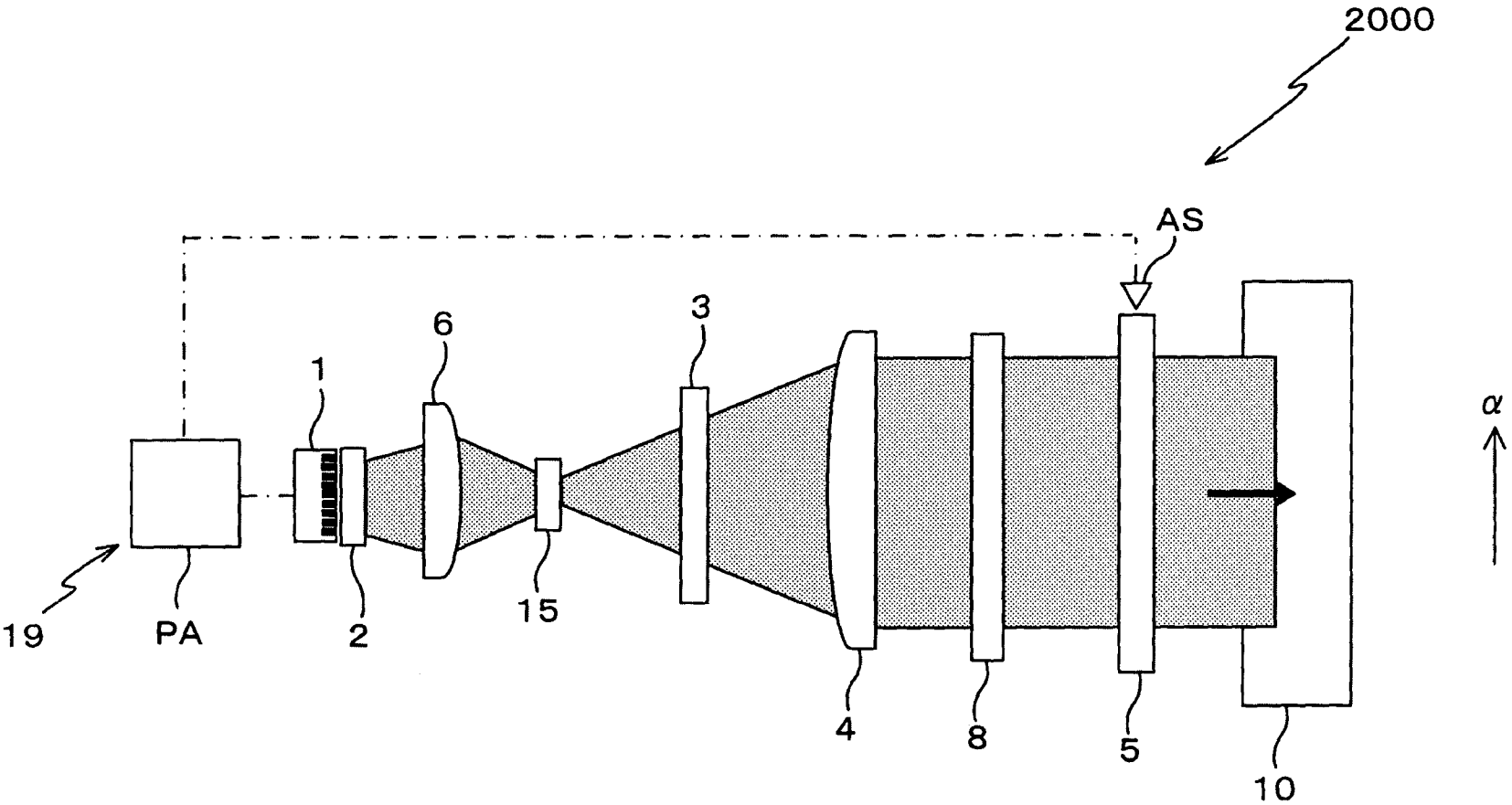
FIGS. 4A and 4B are a first part and a second part of a diagram for explaining a different example of the image erasing apparatus of the present invention.
Figure 4B:
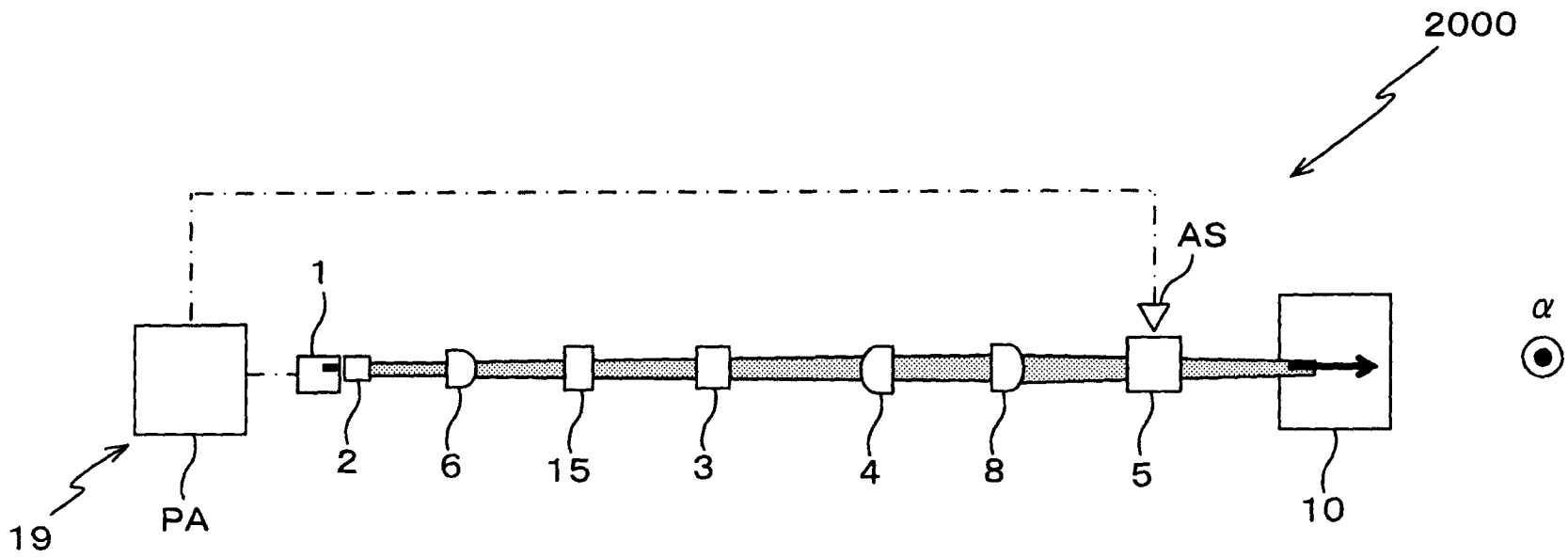

FIGS. 4A and 4B are schematic diagrams illustrating specific embodiments of the image erasing apparatus of the present invention.

The image erasing apparatus 2000 of the present embodiment uses an LD array in which 47 LDs are aligned in an α axis direction, and a length in a longitudinal direction of a light emitting unit of the LD array 1 is 10 mm, for example.

A line-shaped laser light (a line-shaped beam) emitted from the LD array 1 is slightly converged in the width direction with a cylindrical lens 2 as a width direction parallelizing unit to cause the converged light to be incident on a spherical lens 6, with which the incident light is collected to a lens 15.

The lens 15 includes a lens which has a function of diffusing and uniformizing a laser light to expand a length and a width thereof (e.g., a micro lens array, a concave or convex lens array, a Fresnel lens; or a micro lens array TEL-150/500, which is manufactured by LIMO GmbH, and is used in the present embodiment).

The line-shaped beam which passed through the lens 15 is converged in the width direction with the cylindrical lens 3.

The light distribution of the line-shaped beam emitted from the cylindrical lens 2 is not uniform, since it is a combination of beams emitted from multiple light sources (semiconductor lasers); Thus, it is necessary to configure the optics as described above for uniformizing.

More specifically, a lens with one convex side that has a focal distance of 70 mm as the spherical lens 6, and a lens with one concave side that has a focal distance which varies in accordance with a beam width as the cylindrical lens 3 are arranged, so that the beam width of Examples is achieved by using −1,000 mm, −400 mm, and −200 mm. The convex lens array is arranged to have steps in the length direction at 40 μm intervals.

The line-shaped beam which passed through the cylindrical lens 3 is parallelized in the length direction with a spherical lens 4 as a length direction parallelizing unit. For the spherical lens 4, a lens with one convex side that has a focal distance of 200 mm is used.

The line-shaped beam which passed through the spherical lens 4 is converged in the width direction with the cylindrical lens 8. For the spherical lens 8, a lens with one convex side that has a focal distance of 200 mm is used.

The line-shaped beam which passed through the cylindrical lens 8 is deflected in the width direction by the scanning unit 5, so that it is scanned on the thermo-reversible recording medium 10. For the scanning unit 5, a monoaxial galvano mirror is used, but in lieu thereof, a stepping mirror motor, a polygon mirror, etc., may be used. The galvano mirror is oscillatable around an axis 5*a* which extends in an a direction.

In the present embodiment, the irradiating energy amount control unit 19 includes an angular sensor AS, which detects an operating state of the scanning unit 5, or in other words an oscillating angle of the galvano mirror; and an output adjusting apparatus PA, which adjusts an output of the LD array 1 based on detected information from the angular sensor AS.

The output adjusting apparatus PA adjusts an output of the LD array 1 such that an energy density of the line-shaped beam irradiated onto the thermo-reversible medium 10 becomes constant regardless of the scanning position of the line-shaped beam scanned by the scanning unit 5.

More specifically, the output adjusting apparatus PA calculates in real time, from a proceeding direction of the line-shaped beam (an angle of incidence onto the thermo-reversible medium 10), a beam width (an irradiation area) in the proceeding direction, and irradiates a laser light of an output in accordance with the calculated beam width. The output adjusting apparatus PA may store in advance, in a memory, data on the beam width for each angle of incidence, and take out, in real time, corresponding data in accordance with the proceeding direction of the line-shaped beam.

The irradiating energy amount control unit 19 may include a heating time adjusting apparatus which adjusts a heating time of the thermo-reversible recording medium 10 based on detected information from the angular sensor AS in lieu of the output adjusting apparatus PA.

Moreover, as described above, the beam width on the thermo-reversible recording medium 10 is $W3(\theta)=W3/\cos\theta$ (see FIG. 10).

Then, in the present embodiment, a position and a focal position of the cylindrical lenses 3 and 8 are set such that $W3(\theta)$ becomes constant as much as possible regardless of $\theta$. As a result, a beam width on the thermo-reversible recording medium 10 of the line-shaped beam may be set to be constant as much as possible regardless of the scanning position of the line-shaped beam.

Figure 5:
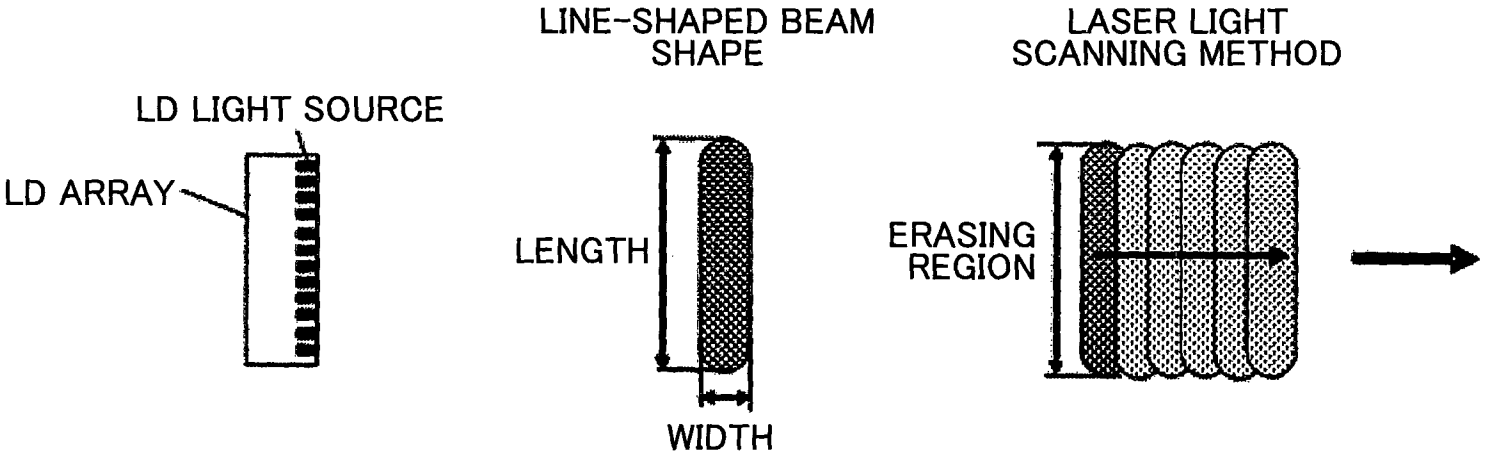
FIG. 5 is a diagram illustrating a shape of a line-shaped beam and a laser light scanning method of the present invention.

According to the image erasing apparatus as shown in FIGS. 3A to 4B, the line-shaped beam on the thermo-reversible recording medium 10, as shown in FIG. 5, has a light distribution which is uniform in the length direction, so that a length of the line-shaped beam becomes one side of an erasing region. A length (distance) over which the line-shaped beam is scanned becomes a remaining side of the erasing region. Then, the line-shaped beam may be scanned only in the width direction (mono-axial direction).

The image erasing apparatuses (1000, 2000) of the above-described respective embodiments include an LD array 1, which emits a line-shaped beam (a laser light with a line-shaped cross section); optics which includes at least one optical lens (width-direction converging unit) that converts, to a converging light which converges in the width direction, the line-shaped beam emitted from the LD array 1 and emits the converging light; and a scanning unit 5 which deflects, in the width direction, a line-shaped beam which is converted into the converging light by the optics and emitted and scans the deflected line-shaped beam on the thermo-reversible recording medium 10.

In this case, it is possible to make the beam width on the thermo-reversible medium 10 of the line-shaped beam constant as much as possible regardless of the scanning position of the line-shaped beam scanned by the scanning unit 5. In other words, the heating time of the thermo-reversible recording medium 10 may be made constant as much as possible regardless of the scanning position of the line-shaped beam. As a result, it is possible to uniformly erase an image recorded on the thermally reversible recording medium 10. The image erasing apparatuses (1000, 2000) make it possible to obtain the above-described advantages sufficiently relative to conventional ones, in particular the larger an angle of incidence of the laser light which is incident on one end and the other end of a scanning stroke on the thermo-reversible recording medium 10, or, in other words, the larger a ratio of the above-described scanning stroke relative to a distance between the scanning unit 5 and the thermo-reversible recording medium 10.

Moreover, compared to the conventional one, it is possible to increase a width of an irradiating energy (below-described NET erasing energy width) that may uniformly erase, over the whole recording region of the thermo-reversible recording medium, an image recorded onto the thermo-reversible recording medium 10. In other words, compared to the conventional one, a width of selecting an irradiating energy amount for uniformly erasing an image recorded on the thermo-reversible recording medium 10 is wide.

Furthermore, the image erasing apparatuses (1000, 2000) include, in addition to the width direction converging unit, an optical lens (a length direction parallelizing unit) which parallelizes, in the length direction, a line-shaped beam which is caused to be incident by the scanning unit 5.

In this case, it is possible to make the beam length on the thermo-reversible medium 10 of the line-shaped beam constant regardless of the scanning position of the line-shaped beam scanned by the scanning unit 5. In other words, an area of irradiating onto the thermo-reversible recording medium 10 of the line-shaped beam may be set to be constant as much as possible regardless of the scanning position of the line-shaped beam. As a result, it is possible to more uniformly erase an image recorded on the thermally reversible recording medium 10.

Moreover, the image erasing apparatuses (1000, 2000) include, in addition to the width direction converging unit and the length direction parallelizing unit, a length direction light distribution uniformizing unit which uniformizes, in the length direction, a line-shaped beam which is caused to be incident by the scanning unit 5.

In this case, an irradiating energy density on the thermo-reversible recording medium 10 of the line-shaped beam may be set to be constant as much as possible regardless of the scanning position of the line-shaped beam. As a result, it is possible to more uniformly erase an image recorded in the thermo-reversible recording medium 10.

Moreover, the image erasing apparatuses (1000, 2000) include, in addition to the width direction converging unit, the length direction parallelizing unit, and the length direction light distribution uniformizing unit, and an irradiating energy amount control unit which controls an amount of energy of the line-shaped beam irradiated onto the thermo-reversible recording medium 10. As a result, it is possible to erase an image recorded on the thermally reversible recording medium 10 in an extremely uniform manner.

With erasing by the line-shaped beam, it suffices to scan the laser light only in a monoaxial direction, making it possible to decrease the scanning mirrors, making control easy, and making it possible to achieve low cost.

The erasing with the line-shaped beam makes it possible to erase with lower energy relative to a circular beam. This is an advantage due to the line-shaped beam being used as a light source making it possible to reduce energy loss due to thermal diffusion.

The line-shaped beam does not require that jumping (a laser light scanning which does not irradiate a laser light) be performed with a laser light scanning, so that an erasing time is not extended due to the jumping.

Compared to a fiber coupled LD, the LD array makes it possible to easily obtain a high output at low cost.

A background portion density normally increases with performing erasing repeatedly; a limit by which it increases by 0.02 relative to an initial background portion density is, relative to 400 times for the circular beam, 5,000 times for the line-shaped beam, which is a significant improvement. This is because it is not necessary to have superimposed laser beam scanning.

The image erasing method and the image erasing apparatus of the present invention make it possible to repeatedly perform, in a non-contact manner, erasing on a thermo-reversible recording medium such as a label pasted onto a container such as a cardboard box, a plastic container, etc. Therefore, they can, in particular, preferably be used for distribution and delivery systems. In this case, for example, an image may be recorded on and erased from the label while moving the cardboard box or the plastic container placed on the conveyor, making it possible to reduce shipping time in that stopping of the line is not necessary.

Moreover, the cardboard box or the plastic container to which the label is pasted may be re-used as it is without peeling off the label therefrom, making it possible to perform image erasing and recording again.

EXAMPLES

Described below are Examples of the present invention, which, however, is not at all limited thereto.

Production Example 1

Production of Thermo-Reversible Recording Medium

A thermo-reversible recording medium in which color tone reversibly changes by heat was produced as follows:

Support

As a support, a white turbid polyester film (TETORON FILM U2L98W, manufactured by Teijin DuPont Films Japan Limited) with a thickness of 125 μm was used.

Formation of First Oxygen Barrier Layer 5 mass parts of an urethane-based adhesive (TM-567, manufactured by Toyo-Morton, Ltd.), 0.5 mass parts of isocyanate (CAT-RT-37, manufactured by Toyo-Morton, Ltd.), and 5 mass parts of ethyl acetate were added and stirred well to prepare an oxygen barrier layer coating solution.

Next, onto a silica-deposited PET film (TECHBARRIER HX, manufactured by Mitsubishi Plastics, Inc., oxygen permeability: 0.5 ml/m$^2$/day/MPa), the oxygen barrier layer coating solution was applied using a wire bar, and heated and dried at 80° C. for 1 minute. The silica-deposited PET film with an oxygen barrier layer formed as described above was affixed onto the support, heated at 50° C. for 24 hours, forming a first oxygen barrier layer with a thickness of 12 μm.

Formation of First Thermo-Reversible Recording Layer

Using a ball mill, 5 mass parts of a reversible developer represented by Structural Formula (1) below, 0.5 mass parts each of two types of color erasure accelerators represented by Structural Formula (2) and Structural Formula (3) below, 10 mass parts of a 50 mass % acrylpolyol solution (hydroxyl value=200 mgKOH/g), and 80 mass parts of methyl ethyl ketone were pulverized and dispersed until an average particle diameter became approximately 1 μm.

CHEM 3

STRUCTURAL FORMULA (1)

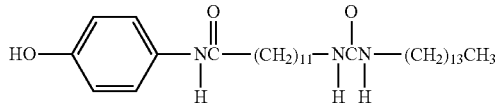

CHEM 4

STRUCTURAL FORMULA (2)

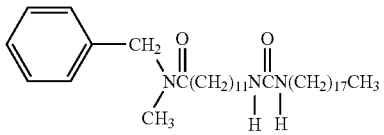

CHEM 5

STRUCTURAL FORMULA (3)

$C_{17}H_{35}CONHC_{18}H_{35}$

Next, into the dispersion solution in which the reversible developer were pulverized and dispersed, 1 mass part of 2-anilino-3-methyl-6-dibutylaminofluoran as leuco dyes, and 5 mass parts of isocyanate (CORONATE HL, manufactured by Nippon Polyurethane Industry Co., Ltd.) were added, and stirred well to prepare a thermo-reversible recording layer coating solution.

The thermo-reversible recording layer coating solution obtained was applied onto the first oxygen barrier layer using a wire bar, and dried at 100° C. for 2 minutes, after which it was cured at 60° C. for 24 hours to form a first thermo-reversible recording layer with a thickness of 6.0 μm.

Formation of Photothermal Conversion Layer 4 mass parts of 1 mass % of phthalocyanine-based photothermal conversion material solution (IR-915, manufactured by NIPPON SHOKUBAI Co., Ltd. absorption peak wavelength: 956 nm), 10 mass parts of mass 50% acrylpolyol solution (hydroxyl value=200 mgKOH/g), 20 mass parts of methyl ethyl ketone, and 5 mass parts of isocyanate (CORONATE HL, manufactured by Nippon Polyurethane Industry Co., Ltd.) as a cross-link agent were stirred well to prepare a photothermal conversion layer coating solution. The photothermal conversion layer coating solution obtained was applied onto the first thermo-reversible recording layer using a wire bar, and dried at 90° C. for 1 minute, after which it was cured at 60° C. for 24 hours to form a photothermal conversion layer with a thickness of 3 μm.

Formation of Second Thermo-Reversible Recording Layer

The same composition for the thermo-reversible recording layer as that of the first thermo-reversible recording layer was applied onto the photothermal conversion layer using a wire bar, and dried at 100° C. for 2 minutes, after which it was cured at 60° C. for 24 hours to form a second thermo-reversible recording layer with a thickness of 6.0 μm.

Formation of Ultraviolet Absorbing Layer 10 mass parts of 40 mass % ultraviolet absorbing polymer solution (UV-G300, manufactured by NIPPON SHOKUBAI CO., LTD.), 1.5 mass parts of isocyanate (CORONATE HL, manufactured by Nippon Polyurethane Industry Co., Ltd.), and 12 mass parts of methyl ethyl ketone were added and stirred well to prepare an ultraviolet absorbing layer coating solution.

Next, the ultraviolet absorbing layer coating solution was applied onto the second thermo-reversible recording layer using a wire bar, and heated and dried at 90° C. for 1 minute, after which it was heated at 60° C. for 24 hours to form an ultraviolet absorbing layer with a thickness of 1 μm.

Formation of Second Oxygen Barrier Layer

The same silica-deposited PET film with the oxygen barrier layer as the first oxygen barrier layer was affixed onto the ultraviolet absorbing layer, heated at 50° C. for 24 hours, forming a second oxygen barrier layer with a thickness of 12 μm.

Formation of Back Layer 7.5 mass parts of Pentaerythritol hexaacrylate (KAYARAD DPHA, manufactured by Nippon Kayaku Co., Ltd.), 2.5 mass parts of an urethane acrylate oligomer (ART RESIN UN-3320HA, manufactured by Negami Chemical Industrial Co., Ltd.), 2.5 mass parts of a needle-like conductive titanium oxide (FT-3000, major axis=5.15 μm, minor axis=0.27 μm, structure: titanium oxide coated with antimony-doped tin oxide; manufactured by Ishihara Sangyo Kaisha, Ltd.), 0.5 mass parts of a photopolymerization initiator (IRGACURE 184, manufactured by Nihon Ciba-Geigy K.K.), and 13 mass parts of isopropyl alcohol were added, stirred well using a ball mill to prepare a back layer coating solution.

Next, the back layer coating solution was applied with a wire bar onto a face of the side of the support on which the first thermo-reversible recording layer, etc., is not formed, and heated and dried at 90° C. for 1 minute, after which it was cross linked with an ultraviolet lamp of 80 W/cm to form a back layer with a thickness of 4 μm. As described above, a thermo-reversible recording medium of Production Example 1 was produced.

Production Example 2

Production of Thermo-Reversible Recording Medium

A thermo-reversible recording medium of Production Example 2 was produced in the same manner as in Production Example 1, except that lanthanum boride as a photothermal conversion material was applied to a thermo-reversible recording layer coating solution so as to obtain the same sensitivity as Production Example 1 to form a first thermo-reversible recording layer with a thickness of 12 μm, and that a second thermo-reversible recording layer, a photothermal conversion layer, and a barrier layer were not formed.

Example 1

In Example 1, an erasing energy and an erasing width were measured as follows when changing a beam width around a central position in a scanning direction for a solid image recorded in a thermo-reversible recording medium of Production Example 2 using a line-shaped beam by an image erasing apparatus (an erasing apparatus using a LD array) of the present invention shown in FIGS. 4A and 4B. The results are shown in Table 1.

As an image recording method, image recording was performed with an LD marker apparatus, wherein a laser light was irradiated from a BMU25-975-10-R (center wavelength: 976 nm), which is a fiber coupled LD (a semiconductor laser) manufactured by Oclaro, and the laser light was scanned by a galvano scanner 6230H (manufactured by Cambridge) while being collected with a collecting lens system (which is formed by two fixed lenses, and one moving lens, whose position is adjusted with an angle of a galvano scanner to collect at a distance between the same work units without depending on the galvano scanner) to collect onto the thermo-reversible recording medium.

As an image erasing method, as erasing by a line-shaped beam of the image erasing apparatus of the present invention, in FIGS. 4A and 4B, an optical lens system was assembled using a collimator lens-equipped LD light source JOLD-108-CPEN-1L-976, which is an LD bar light source manufactured by JENOPTIK AG (center wavelength: 976 nm, output: 108 W) as an LD array 1 and a lens 2; a spherical lens with a focal distance of 70 mm as a lens 6; a micro lens array TEL-150/500 manufactured by LIMO as a lens 15; a cylindrical lens as a lens 3; a spherical lens with a focal distance of 250 mm as a lens 4; a cylindrical lens with a focal distance of 300 mm as a lens 8; and a galvano scanner 6230H manufactured by Cambridge, which is a galvano mirror, as a scanning mirror 5; erasing was performed on the thermo-reversible recording medium by scanning 10 mm of a central region at a scanning line speed of 45 mm/s with a line-shaped beam with the width adjusted by changing a focal distance and an installation distance of the lens 3 and the length set to 46 mm.

Measurement of Erasing Energy and Erasing Width

Erasing was performed on a thermo-reversible medium on which a solid image is printed while changing irradiating power in a 5° C. environment to determine erasing energy and an erasing width, in which a difference with a background density became less than or equal to 0.03. The "erasing energy" is defined as an average value of a maximum value and a minimum value of erasable energy, which is irradiating energy of a laser light at which a background density after erasing the solid image becomes less than or equal to +0.03 relative to a background density before forming the solid image. Moreover, the "erasing width" is defined as (maximum value−minimum value)/(maximum value+minimum value) using the maximum value and the minimum value of the erasable energy. For a density measurement, a reflection densitometer (938 Spectro-densito-meter, manufactured by X-rite) was used to perform the measurement.

With respect to characteristics of the erasing energy and the erasing width when the beam width is changed, with a change in the beam width, a heating time of the thermo-reversible medium changes and the erasing characteristics changes. Thus, setting the beam width constant on the thermo-reversible medium also causes the erasing characteristics to match.

Example 1 and Comparative Example 1

In Example 1, a distance between the LD array 1 and the lens 2, and the lens 6 is set to 75 mm; a distance between the lens 6 and the lens 15 is set to 70 mm; a distance between the lens 15 and the lens 3 is set to 175 mm; a distance between the lens 3 and the lens 4 is set to 70 mm; a distance between the lens 4 and the lens 8 is set to 55 mm; a distance between the lens 8 and the scanning mirror 5 is set to 40 mm; and a distance between the scanning mirror 5 and the thermo-reversible recording medium 10 is set to 160 mm.

In the optics system shown in FIGS. 4A and 4B, in Example 1, an installation position of the lenses 3 and 8 (cylindrical lenses) and a distance between the scanning mirror 5 and the thermo-reversible 10 are adjusted to adjust a degree of convergence of the line-shaped beam which is incident on the thermo-reversible recording medium 10, making the beam width on the thermo-reversible recording medium, or, in other words, W3(θ) in FIG. 10 almost constant regardless of θ. Here, the line-shaped beam which is incident onto the thermo-reversible recording medium 10 is collimated (parallelized) in the length direction.

On the other hand, in the Comparative Example 1, the installation position of the lenses 3 and 8 (cylindrical lenses) and the distance between the scanning mirror 5 and the thermo-reversible recording medium 10 were set such as to set the width of the line-shaped beam to be constant regardless of the distance between the scanning mirror 5 and the thermo-reversible recording medium 10. The beam width at the scanning center position is set to 0.5 mm for both Example 1 and Comparative Example 1.

Figure 6A:
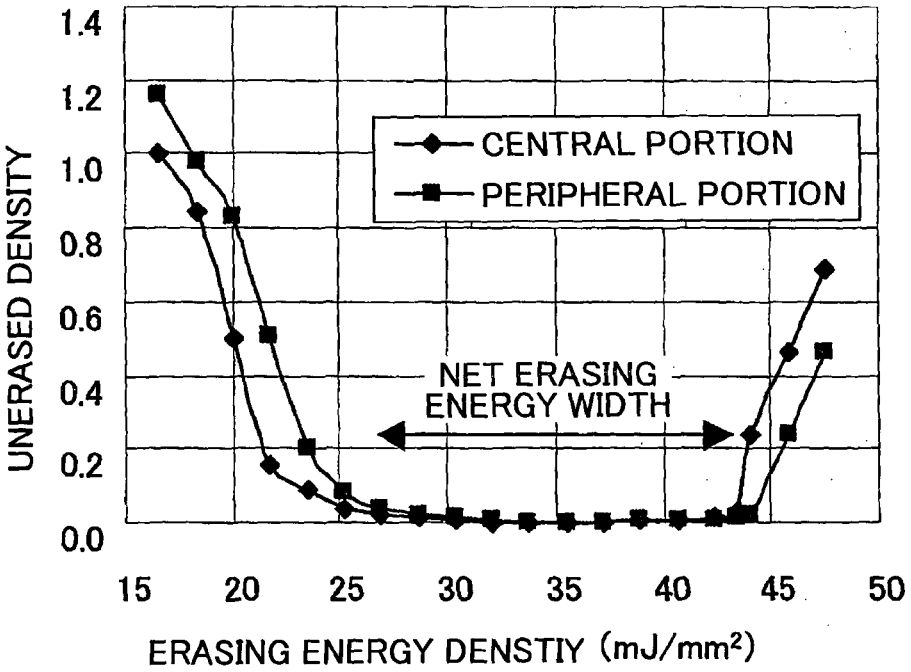
Figure 6B:
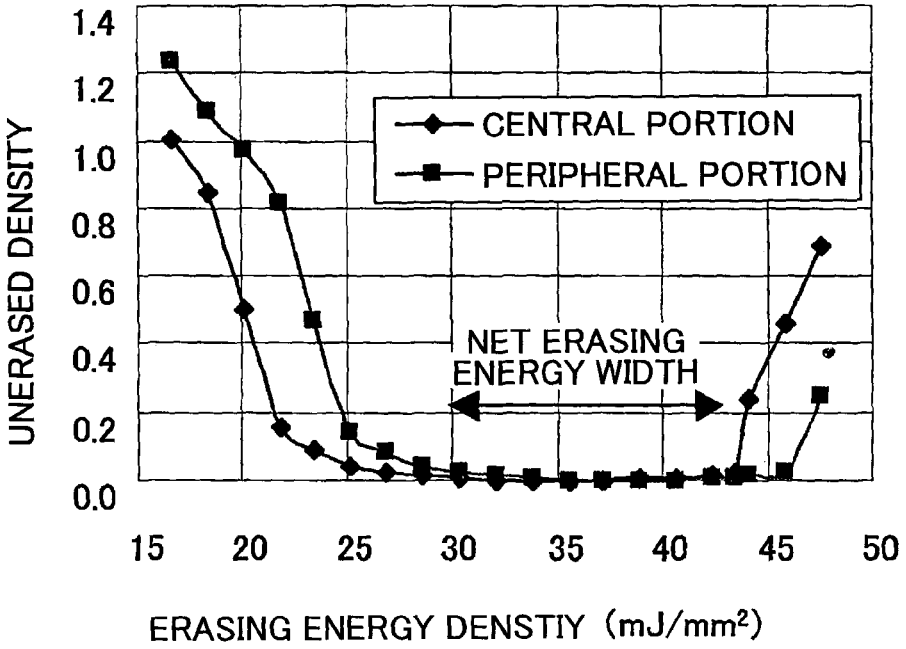
FIG. 6B is a graph illustrating erasing characteristics of the central portion and the peripheral portion of the thermo-reversible recording medium in Comparative Example 1.
Figure 7:
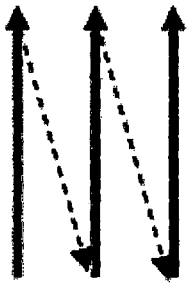
FIG. 7 is a diagram for explaining jumping in laser light scanning (laser light scanning in which a laser light is not irradiated)

For Example 1 and Comparative Example 1, scanning and erasing were made with a scanning speed of 45 mm/s on the thermo-reversible medium for 150 mm of a scanning width on the medium of the scanning mirror at a 5° C. environment. The results are shown in Table 1. FIG. 6A is a graph showing erasing characteristics of Example 1, while FIG. 6B is a graph showing erasing characteristics of Comparative Example 1.

Here, the "NET erasing energy width" is defined as (maximum value−minimum value)/(maximum value+minimum value) using a maximum value and a minimum value of irradiating energy of a laser light at which a background density after erasing the solid image becomes less than or equal to +0.03 in the whole scanning region of 150 mm relative to a background density before forming the solid image.

The NET erasing energy width may improve by a central portion and an edge portion in a scanning direction having equal erasability, and there is a possibility that the erasing energy changes in an actual operation, so that it is important to secure a NET erasing energy as wide as possible.

TABLE 1

| | NET ERASING ENERGY WIDTH |
|---|---|
| EXAMPLE 1 | 22.5% |
| COMPARATIVE EXAMPLE 1 | 18.2% |

Example 2

In Example 1, erasing was performed by adjusting laser irradiating power in accordance with a scanning position of a line-shaped beam at a 5° C. environment to adjust energy to determine the NET erasing energy width. The results are shown in Table 2.

Example 3

In Example 1, erasing was performed by adjusting scanning speed in accordance with a scanning position of a line-shaped beam at a 5° C. environment to adjust energy to determine the NET erasing energy width. The results are shown in Table 2.

TABLE 2

| | NET ERASING ENERGY WIDTH |
|---|---|
| EXAMPLE 2 | 24.6% |
| EXAMPLE 3 | 24.5% |

In the scanning direction, surface reflection becomes larger at the edge portion relative to the central portion as the laser light is obliquely incident onto the thermo-reversible medium, so that energy which may be used for erasing decreases, making it possible to obtain equivalent erasability as the central portion by increasing erasing energy at the edge portion and making it possible to increase a NET erasing energy width.

Example 4

Erasing was performed by performing solid image printing in the same manner as Example 1 except that, in Example 1, a stepping motor mirror was installed in lieu of the galvano mirror in the image erasing apparatus of the present invention shown in FIGS. 4A and 4B, and the stepping motor mirror was controlled such as to perform scanning at a scanning line speed of 45 mm/s, making it possible to completely erase the solid image (the density difference between the erased portion and the background portion was 0.00).

Example 5

In Example 1, erasing was performed by performing solid image printing in the same manner as Example 1 except that, in Example 1, a polygon mirror was installed in lieu of the galvano mirror in the image erasing apparatus of the present invention shown in FIGS. 4A and 4B, and the number of rotations of the polygon mirror was adjusted such as to perform scanning at a scanning line speed of 45 mm/s, making it possible to completely erase the solid image (the density difference between the erased portion and the background portion was 0.00).

Example 6

In Example 1, solid image printing on the thermo-reversible recording medium of Production Example 1 was performed in the same manner as Example 2 by removing the galvano mirror in the image erasing apparatus of the present invention shown in FIGS. 4A and 4B; erasing was performed while moving a plastic box, onto which the thermo-reversible recording medium is affixed, on a conveyor at a conveying speed of 20 mm/s (1.2 m/minute), making it possible to completely erase the solid image (the density difference between the erased portion and the background portion was 0.00)

Example 7

When the solid image erasing was performed, in the same manner as Example 2, on the thermo-reversible recording medium of Production Example 1 in the image erasing apparatus of the present invention shown in FIGS. 4A and 4B in Example 1, the solid image could be erased completely (the density difference between the erased portion and the background portion was 0.00).

Examples 8 and 9

Erasing was performed at 25° C. and 5° C. environments at irradiating power set at 25° C. for Example 8, with a function of performing a correction of increasing irradiating power by 1.1% when the ambient temperature increases by 1° C., with an ambient temperature sensor being installed to the image erasing apparatus of the present invention shown in FIGS. 4A and 4B in Example 1, and for Example 9 without the above-described function, to measure unerased density. The results are shown in Table 3.

TABLE 3

| | 25° C. ENVIRONMENT | 5° C. ENVIRONMENT |
|---|---|---|
| EXAMPLE 8 | 0.00 | 0.00 |
| EXAMPLE 9 | 0.00 | 0.05 |

Examples 10 and 11

Erasing was performed with a distance of 160 mm and 170 mm between the scanning mirror and the thermo-reversible medium for Example 10, with a function of performing a correction which controls the scanning mirror such that the scanning distances become the same regardless of an inter-work distance, with a displacement sensor that measures a distance between the apparatus and the thermo-reversible medium being installed in the image erasing apparatus of the present invention shown in FIGS. 4A and 4B in Example 1; and for Example 11, without the above-described function, to measure the unerased density. The results are shown in Table 4.

TABLE 4

| | 160 mm | 170 mm |
|---|---|---|
| EXAMPLE 10 | 0.00 | 0.00 |
| EXAMPLE 11 | 0.00 | 0.05 |

DESCRIPTION OF NOTATIONS

1 LD array (one-dimensional laser array)
3 Cylindrical lens (a part of optics)
4 Spherical lens (a part of optics)
5 Scanning unit
6 Spherical lens (a part of optics)
8 Cylindrical lens (a part of optics)
9 Width direction converging unit (a part of optics)
10 Thermo-reversible recording medium
15 Lens (a part of optics)

PATENT DOCUMENTS

Patent Document 1: JP2011-104995A

The present application is based on and claims the benefit of priority of Japanese Patent Application No. 2011-265370 filed on Dec. 5, 2011.

The invention claimed is:

1. An apparatus, comprising:

a light source configured to emit laser light whose cross section has a line shape;

optics configured to convert the laser light emitted from the light source to converging light which converges in a width direction to emit the converging light, and parallelize the laser light emitted from the light source in a length direction to emit the parallelized laser light; and a scanning unit configured to deflect, in the width direction, the laser light emitted from the optics to scan the deflected laser light on a thermo-reversible recording medium, wherein the apparatus is configured to scan the deflected laser light onto the thermo-reversible recording medium on which an image is recorded to erase the image.

2. The apparatus of claim 1, wherein the optics comprises a collecting element which is arranged such that a width of the laser light on the thermo-reversible recording medium becomes constant regardless of a scanning position of the laser light scanned by the scanning unit.

3. The apparatus of claim 2, wherein the collecting element is a cylindrical lens.

4. The apparatus of claim 1, wherein the optics uniformizes a light distribution in the length direction of the laser light emitted from the light source to emit the laser light.

5. The apparatus of claim 1, further comprising:

a first irradiating energy amount control unit which controls an energy amount of the laser light irradiated onto the thermo-reversible recording medium in accordance with a scanning position of the laser light scanned by the scanning unit.

6. The apparatus of claim 1, further comprising:

a second irradiating energy amount control unit which measures a temperature of the thermo-reversible recording medium or surroundings thereof to control an energy amount of the laser light irradiated onto the thermo-reversible recording medium based on the measured temperature.

7. The apparatus of claim 1, further comprising:

a third irradiating energy amount control unit which measures a distance between the thermo-reversible recording medium and the scanning unit to control an energy amount of the laser light irradiated onto the thermo-reversible recording medium based on the measured distance.

8. The apparatus of claim 1, wherein the light source comprises a plurality of one-dimensionally aligned semiconductor lasers.

9. An image erasing method, comprising:

converting laser light whose cross section has a line shape to converging light which converges in a width direction;

parallelizing the laser light in a length direction; and deflecting, in the width direction, the laser light converted to the converging light to scan the deflected laser light onto the thermo-reversible recording medium, wherein the thermo-reversible recording medium on which an image is recorded is scanned with the deflected laser light to erase the image.

* * * * *